US011117740B2

(12) United States Patent
Treat

(10) Patent No.: US 11,117,740 B2
(45) Date of Patent: Sep. 14, 2021

(54) EXTERNALLY CONTROLLED AERATOR CONTROL MODULE AND BLAST AERATOR EQUIPPED THEREWITH

(71) Applicant: Global Manufacturing Inc., Little Rock, AR (US)

(72) Inventor: Rodney D. Treat, Benton, AR (US)

(73) Assignee: Global Mfg. Inc., Little Rock, AR (US)

( * ) Notice: Subject to any disclaimer, the term of this patent is extended or adjusted under 35 U.S.C. 154(b) by 0 days.

(21) Appl. No.: 16/985,757

(22) Filed: Aug. 5, 2020

(65) Prior Publication Data

US 2020/0361703 A1 Nov. 19, 2020

Related U.S. Application Data

(63) Continuation-in-part of application No. 16/380,322, filed on Apr. 10, 2019, now Pat. No. 10,737,877.

(60) Provisional application No. 62/664,492, filed on Apr. 30, 2018.

(51) Int. Cl.
*B65D 88/70* (2006.01)

(52) U.S. Cl.
CPC ..... *B65D 88/703* (2013.01)

(58) Field of Classification Search
CPC .... B65D 88/703; B65D 88/706; B65D 88/72; B65D 88/74; B65D 88/741
See application file for complete search history.

(56) References Cited

U.S. PATENT DOCUMENTS 3,915,339 A * 10/1975 Matson ..... B65D 88/703 222/3
4,197,966 A * 4/1980 Wadensten ..... B65D 88/703 222/1
4,346,822 A * 8/1982 Wadensten ..... B65D 88/703 222/195
4,469,247 A 9/1984 Tompkins
4,496,076 A * 1/1985 Tompkins ..... B65D 88/703 222/195
4,703,869 A * 11/1987 De Rooy ..... B65D 88/703 222/3
4,767,024 A * 8/1988 Rappen ..... B65D 88/703 222/195
6,321,939 B1 11/2001 Treat
(Continued)

*Primary Examiner* — Donnell A Long
(74) *Attorney, Agent, or Firm* — Stephen D. Carver

(57) ABSTRACT

A blast aerator (20) having a discharge end (23) connected internally to a rigid output tube (24) includes a removable aerator control module (15) that internally, sealingly interacts with the output tube (24). A tank discharge pipe (28) directs air blasts into an external application. The aerator control module (15) comprises an external actuator (30) with a trigger valve (85) that controls a reciprocating plunger assembly (50) that interacts with an internal plunger seat (77) to block or unblock air discharge. A plunger seat adaptor assembly (70) fitted to the aerator output tube (24) comprises a resilient plunger seat (77), that is blocked or unblocked by a plunger element (52) reciprocating within a cage (73), being controlled by a slidable piston (38) that is pneumatically displaceable between tank-filling and tank discharge positions within the actuator (30). The plunger seat adaptor assembly (70) mechanically compensates for output tube misalignment to insure proper sealing. Operational air pathways pneumatically control piston movements without springs.

8 Claims, 19 Drawing Sheets

(56) References Cited

U.S. PATENT DOCUMENTS

| | | | | |
|---|---|---|---|---|
| 6,726,059 | B2 | 4/2004 | Treat | |
| 6,702,248 | B2 | 5/2004 | Treat | |
| 7,837,062 | B2 * | 11/2010 | Pronschinske ..... | B65D 88/703 222/3 |
| 2005/0151100 | A1 * | 7/2005 | Dalmasso ..... | F16K 24/06 251/28 |
| 2021/0002071 | A1 * | 1/2021 | Kallarackal ..... | B65D 88/703 |

* cited by examiner

EXTERNALLY CONTROLLED AERATOR CONTROL MODULE AND BLAST AERATOR EQUIPPED THEREWITH

CROSS REFERENCE TO RELATED APPLICATION

This application is based upon and claims priority from prior U.S. Utility patent application Ser. No. 16/380,322, filed 10 Apr. 2019, and entitled "Externally Controlled Retrofittable Aerator Control Module and Blast Aerator Equipped Therewith", by inventor Rodney D. Treat (American Citizen), which was based upon and claimed priority from prior U.S. Provisional Application Ser. No. 62/664,492, filed 30 Apr. 2018, entitled "Blast Aerator with Plunger Valve Controlled by an External Actuator", by inventor Rodney D. Treat.

BACKGROUND OF THE INVENTION

I. Field of the Invention

The present invention relates generally to industrial air cannons or blast aerators and their replacement parts. More particularly, the present invention relates to blast aerators with an input end mounting a modularized, piston equipped control system for activation of an internal air discharge pathway that provides blast outputs.

II. Description of the Prior Art

Modern industrial blast aerators, which are sometimes called "air cannons" or "air blasters", typically comprise a compressed air reservoir with a quick-opening valve that periodically releases stored air in a sudden, high-energy blast. Blast aerators are used by numerous industries to facilitate material flow. The blast aerator's powerful air discharge is directed through an output pathway comprising a pipe or the like to aerate and dislodge bulk material, and restore flow in bins, hoppers, silos, rotary kilns, etc. Current blast aerator designs date back to the early 1980's.

Various prior art designs that have been previously manufactured and employed typically share similar characteristics. For example, all known aerator designs comprise a rigid tank with a rigid, internal tube that connects an air supply port to a spaced-apart discharge port. Usually a quick opening valve mounted within or upon the tube allows air stored in the tank to suddenly and quickly re-enter the tube so it can exit the discharge port. In each case the valve utilizes a disc or piston that opens and closes the path for air blast discharge. For example, this piston or disc may be controlled by air pressure applied to each side of the disc. When the pressure on the air supply side of the disc is greater than the pressure on the discharge side of the disc, the disc closes off the path to the discharge port. If the pressure on the air supply side of the disc is reduced, the pressure in the tank pushes the disc or piston back, allowing the air in the tank to escape through the path to the discharge port.

Typical blast aerator designs vary in construction. For example, the location of the quick opening valve in one common configuration is near the discharge port. This allows the tube connecting the air supply port to the valve to be smaller in diameter, since its function is to supply air to fill the reservoir and to draw air out from the air supply side of the disc to trigger the valve to open and fire the air cannon. This type of design maximizes the volume of the tank because the small fill line uses little of the space inside the tank. A significant disadvantage is that the entire air cannon has to be removed from its mount to service the valve components. To overcome this disadvantage, external valves were developed.

In external valve designs a tube still connects the air supply port to the discharge port with the valve in the middle, but the air reservoir is attached to the side of the tube instead of enclosing the tube. This allows virtually the entire volume of the tank to be used for air storage and allows the valve parts to be easily accessed for maintenance without dismounting the pressure vessel. The disadvantage of the external valve design is that the air leaving the tank must travel through one or more tight turns before reaching the discharge port. Irregularities in the discharge pathway seriously reduce the force of the air cannon's output blast. This disadvantage becomes proportionally greater as the size of the pressure vessel is increased.

As an example of known prior art designs, U.S. Pat. No. 4,469,247 issued Sep. 4, 1984 discloses a blast aerator for dislodging bulk materials in storage hoppers or the like. The blast aerator tank has an elongated, rigid blast discharge pipe coaxially disposed therewith. A valve seat assembly is coaxially secured against an internal shoulder of the pipe. A resilient dual diameter piston is disposed within an intermediate portion of the pipe for axial movement between a sealing, aerator fill position, wherein its reduced diameter portion abuts the valve seat assembly and a rearward, aerator discharge position. The piston is urged rearwardly when the unit is vented to discharge an air blast U.S. Pat. No. 4,496,076 issued Jan. 29, 1985 discloses a multiple blast aerator hopper system for handling bulk material. This comprises plurality of blast aerators fitted at radially, spaced-apart intervals about the periphery of a hopper needing flow control. The blast aerators are periodically fired in a timed, rotary sequence starting with the first, lowermost aerator and continuing serially with higher, radially spaced-apart aerators. Preferably each aerator includes an internal valve seat assembly which houses a resilient, dual diameter piston for axial movement between the sealing position and a rearward, aerator fill position. An external solenoid valve controls each aerator.

U.S. Pat. No. 6,702,248 issued Mar. 9, 2004 discloses a quick acting blast aerator comprising a spring-less actuator triggered by an exhaust valve. The actuator valve comprises a tubular body, an exhaust vent defined in the body, a dampening passageway, and a piston slidably disposed therewithin for movement between a tank filling position and a displaced, air discharge position. Preferably the piston has a projecting dampener which engages the dampening passageway.

U.S. Pat. No. 6,726,059 issued Apr. 27, 2004 discloses a "Quick release trigger valve and blast aerator" that discloses an externally-mounted, quick-acting trigger assembly for firing blast aerators, air cannons, or the like. The trigger comprises a symmetrical, ventilated housing that internally mounts a hollow piston. A plurality of vent orifices are radially disposed about the housing periphery, and normally covered by a resilient band forming a check valve. The trigger piston comprises a generally cylindrical base and an integral, generally conical bottom that is displaced into and out of contact with a mechanical valve seat. An air passageway through the piston is controlled by a deflectable spherical valve element that is captivated within the piston, for selectively blocking air passage through the piston by contacting an internal valve seat. This construction with internal air passageways facilitates trigger function. The base comprises a circumferential groove for seating an appropriate O-ring.

Relatively recently blast aerator designs place the valve at the air supply end of the tube connecting the air supply port to the discharge port. Since the valve is at the opposite end of the pressure vessel from the discharge port where the blast aerator is mounted to the application, it can be more readily accessed for valve maintenance without dismounting the entire air cannon. With the valve located at the air supply end of the tube, the diameter of the entire tube must remain large (i.e., the same size as the discharge port) for the entire length of the pressure vessel. This wastes a considerable amount of the tank's internal volume.

Another shortcoming of the supply end mounted valve involves manufacturing concerns. Typically, a relatively long, four inch diameter tube is mounted in the discharge end of the tank. To ensure internal connections of this tube to the valve requires tight tolerances to align the supply end of the tube accurately in the center of the tank. If this end of the tube is off-center or tilted, the connections are likely to leak. Also, schedule 40 pipe is frequently used for this tube. Its tolerances do not meet the requirements of standard O-ring seals. If this connection leaks, the blast aerator will constantly leak air while in the charged state waiting to be fired.

The basic blast aerator design using a tube connecting the air supply port to the discharge port has worked relatively well for over thirty years. There are a few short comings, however. After the firing of an air cannon, the area on the discharge side of the valve disc, extending down into the discharge pipe, has very low pressure. This allows air from the application, which might contain abrasive contaminants and/or caustic and corrosive chemicals, to be sucked up into the valve, shortening the aerator's useful life, and creating the need for frequent maintenance and replacement of valve components.

Another weakness of the prior art "tube" design is based on theoretical considerations. The majority of air cannons used today in industry have a four inch internal diameter discharge port. Regardless of whether the valve is located at the air inlet port or at the discharge port, there must be openings in the tube ("windows") that allow air accumulated within the aerator tank to rapidly escape via the tube through and out the discharge port. The four inch discharge port has a cross-sectional area of 12.56 sq. in. for air to enter. Traditionally, air cannons use a valve that is the same size as the discharge port. With a valve that is four inches in diameter, the windows in the tube normally have a cross-sectional area smaller than the discharge port by 20% or more. This provides a choke point for the air trying to exit the tank, reducing the force of the blast.

One manufacturer now uses a larger valve placed near the air supply port. This requires the tube at the air inlet end to be a larger diameter, but it allows the windows to be large enough to be greater in cross-sectional area than the discharge port. Tests will be done to see how much more force is obtained by this approach to removing this choke point.

One final disadvantage of the "tube" design is that the disc that opens the path for the air to reach the discharge is subject to the changing pressure and turbulence in the pressure vessel. The disc is controlled by the balance of pressure on the supply side and the discharge side of the disc. As the air leaves the tank a low pressure area develops on the discharge side of the disc causing it to start to close until it is hit again by air trying to leave, which pushes it fully open again. Testing has revealed that this fluctuating pressure on the discharge side of the disc causes the disc to "flutter" back and forth as the air leaves the tank. This constant back and forth movement of the disc can greatly enhance wear. If a spring is used to control the disc and close it quickly after the blast, that spring is compressed and released hundreds of times with each blast. This can severely shorten spring life. Also, if any abrasive contaminants from the application get into the valve (as mentioned above), this back and forth motion can severely abrade the disc and the valve housing. This can significantly shorten valve life.

SUMMARY OF THE INVENTION

This invention provides an improved "tubeless" blast aerator, and a module for the aerator wherein a pneumatic piston and plunger arrangement accumulates tank pressure and thereafter is selectively triggered, discharging the aerator.

The preferred blast aerator or air cannon comprises a steel, air accumulation tank with an actuator end that removably receives an aerator control module. A tank discharge end mounts a discharge pipe that connects to an internal tube semi-permanently mounted within the tank. The external aerator discharge pipe directs air blasts into an external application, such as a bulk material bin. Conventional primary tubing or piping, typical discharge "windows," and conventional actuation valving are eliminated from the interior of the aerator tank. The preferred piston is springless. Critical operational air pathways pneumatically control piston movements, air charging cycles, and blast discharges.

The aerator control module operates a projecting, reciprocating plunger assembly that interacts with an internal plunger seat that is periodically blocked to accumulate air, or unblocked to enable a blast air flow. The plunger seat, that is mechanically fitted to the aerator output tube, is blocked or unblocked by a plunger element controlled by a slidable actuator piston that is pneumatically displaceable between tank-filling and tank discharge positions within the aerator control module. The plunger rod comprises an internal air passageway for filling the tank. A cage, preferably comprising a plurality of radially spaced apart plunger guide rods, properly positions and aligns the plunger seat, and prevents misalignment of the plunger assembly to insure proper sealing.

Thus a basic object of this invention is to provide a blast aerator whose critical innards can be changed without removing the aerator tank itself from its application.

A basic goal is to provide user-access to all blast aerator parts without requiring cumbersome dismounting and remounting of the aerator tank from the application.

A related object is to locate the aerator's critical actuator outside the pressure vessel, protected from any contaminants that might be pulled up into the tank after firing within the discharge pipe.

A related object is to secure the aerator actuator outside the air cannon pressure vessel, isolating it from changing pressures, turbulence and the like, to eliminate actuator piston flutter and the excessive wear this flutter causes.

It is also an object to provide a blast aerator and a repair module for an aerator wherein parts are accessible from a single end of the unit. It is a feature of the invention that the actuator, plunger assembly, and plunger seat adaptor assembly can all be installed or serviced from a mounting flange on the end of the tank opposite the discharge pipe and mount.

It is also an important object to eliminate the discharge tube windows that characterize prior art blast aerator designs.

Another object is to provide an aerator and repair actuator module where the piston operates without a conventional mechanical spring. It is a feature of my invention that the piston is controlled pneumatically with suitable ports and air passageways for complete control.

Similarly it is an object to provide a "tubeless" design wherein the actuator is external to the tank and thus is not influenced by the air movement in the tank. This greatly reduces flutter of the actuator piston and wear on the piston and actuator housing.

It is also an important object to greatly ease and simplify aerator maintenance and periodic servicing.

Of course it is a basic object of this invention to provide a blast aerator of significantly improved efficiency and operating life.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE SEVERAL VIEWS OF THE DRAWINGS

Figure 1:
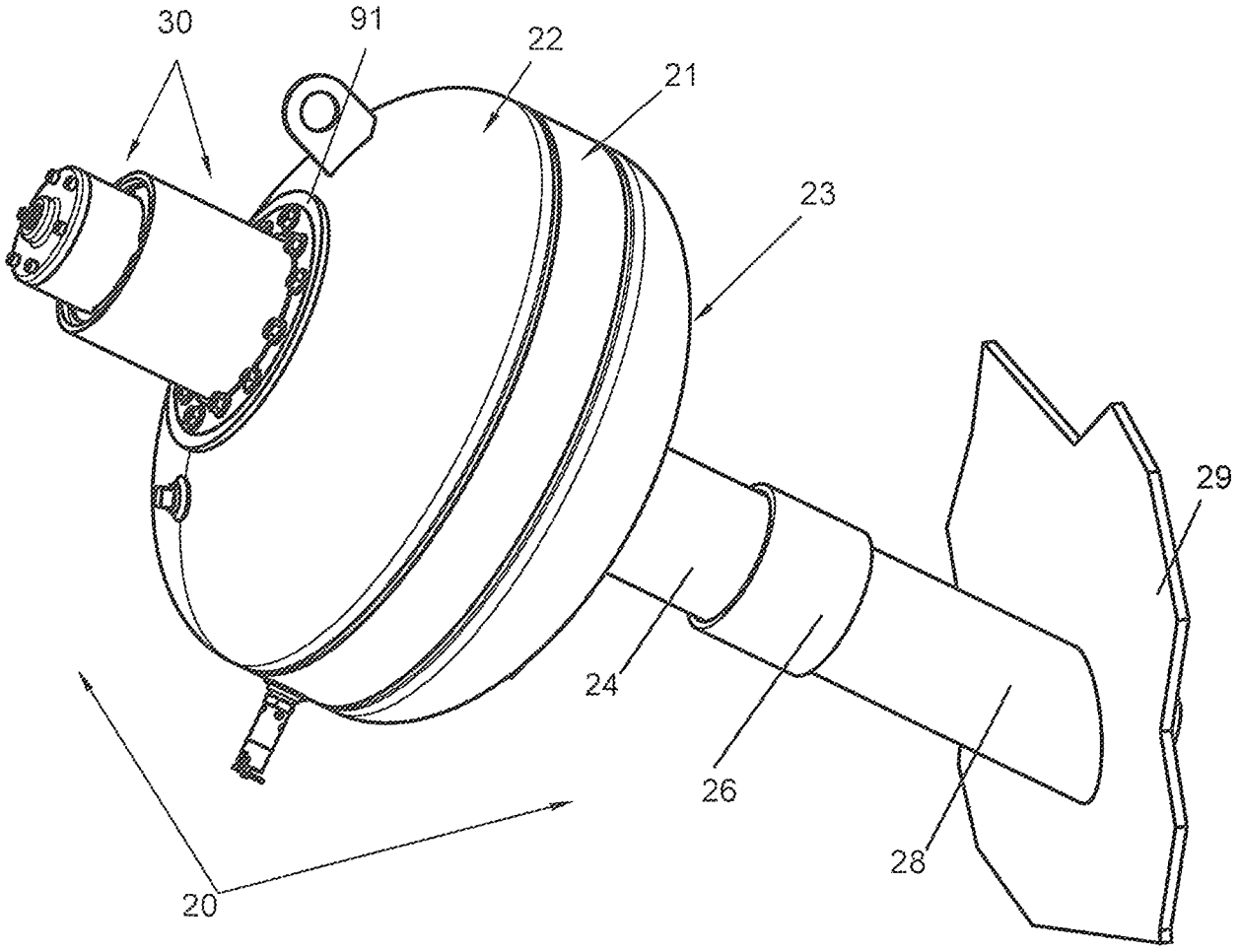
FIG. 1 is a fragmentary, isometric view of my new blast aerator constructed in accordance with the best mode of the invention, showing it mounted to a typical application.
Figure 2:
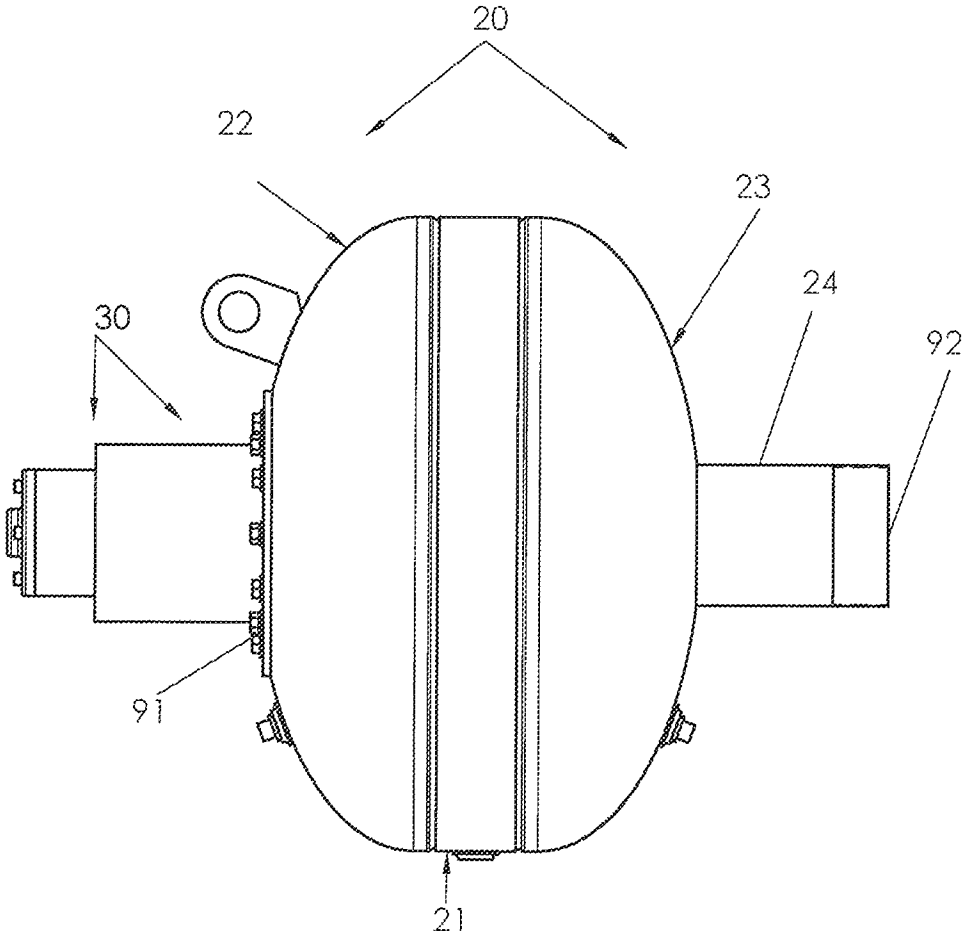
FIG. 2 is a side elevational view of the preferred blast aerator.
Figure 3:
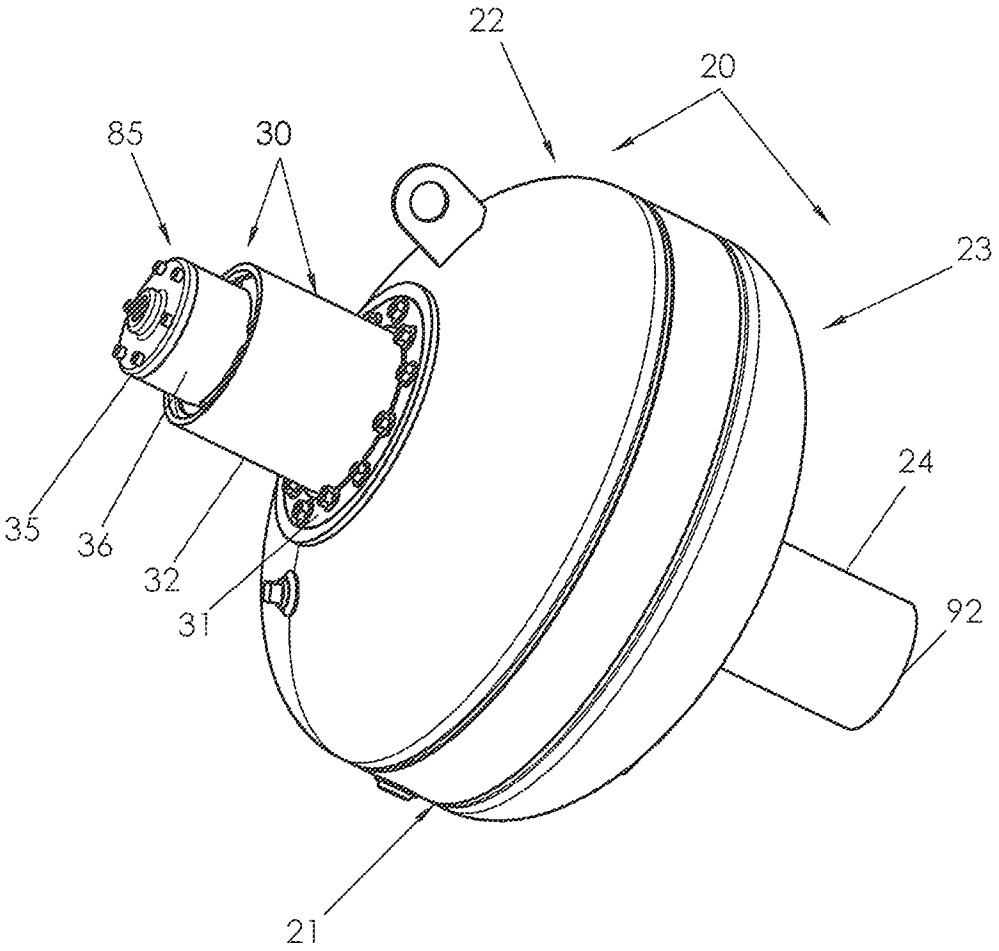
FIG. 3 is a fragmentary isometric view of the aerator.

Turning initially to FIGS. 1-4 of the appended drawings, a blast aerator or air cannon constructed in accordance with the best mode of the present invention has been generally designated by the reference numeral 20. The new aerator control module 15 seen in FIG. 4 and elsewhere, is employed by aerator 20 and it is adapted for quick removal, enabling service and maintenance of all wearing parts without removing the blast aerator 20 from its mounting or application.

Blast aerator 20 comprises a rigid, preferably steel, high-pressure, air accumulation tank 21 having a pair of integral, spaced-apart, tapered or convex ends ends 22, 23. An actuator mounting end 22 of the blast aerator supports an actuator assembly 30 to be described below. In an actual installation, the aerator end 22 is located for convenient accessibility by service personnel. The spaced-apart aerator tank discharge end 23, on the other hand, is mechanically braced by and connected to an application, such as a storage bin or tank, and is not easily serviced or accessed. Maneuvering is facilitated by a rigid tab 25.

Figure 9:
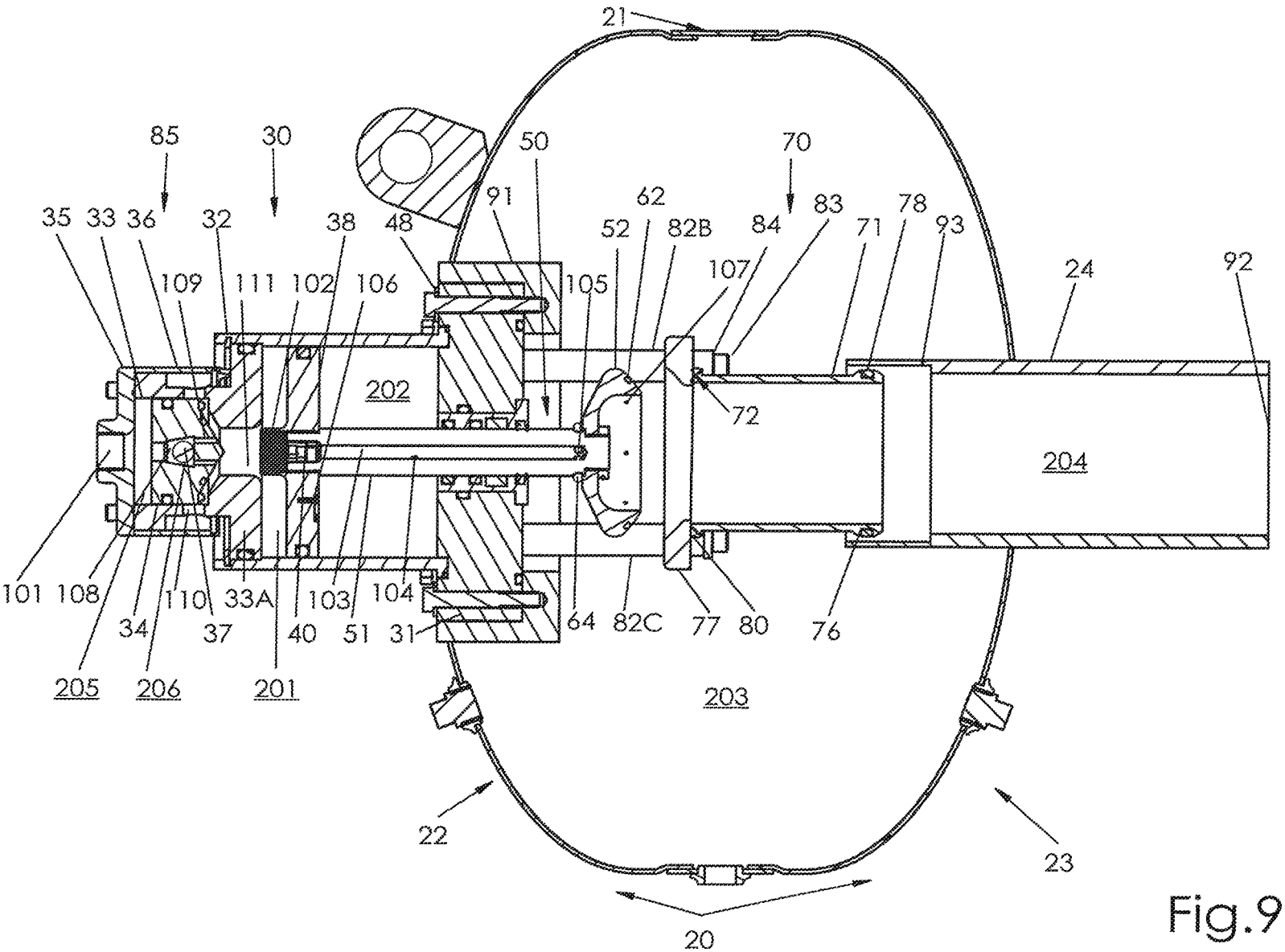
FIG. 9 is an enlarged, longitudinal sectional view of the aerator.

Aerator discharge end 23 supports the aerator output tube 24 which is welded in place during tank fabrication. The aerator output tube 24 is constructed of schedule 80 pipe and has an internally machined ID end 93 (FIG. 9) disposed internally within the tank, and a threaded distal end which serves as the aerator discharge port 92 (FIG. 9). The distal end of the output tube 24 has conventional pipe threads so it is joined via external pipe coupling 26 to the discharge pipe 28 leading to the application (FIG. 1). The air outlet pathway 204 within output tube 24 can be unblocked to periodically conduct air accumulated under pressure within the tank interior 203 to the outside of the tank. Blast discharge pipe 28 (i.e., FIG. 1), directs air blasts into an application, such as a bulk material tank, hopper or granular material reservoir through a wall 29 of the application. Discharge pipe 28 passes through and may mechanically connect to the wall 29 of the application, so that the aerator 20 can periodically, forcibly discharge air blasts interiorly of the application to loosen bulk materials therewithin and promote material flow, as will be recognized by those skilled in the art.

Importantly, an externally mounted actuator 30 initiates air blasts from the blast aerator 20. Actuator 30 includes a trigger valve 85, preferably comprising a quick exhaust valve (referred to hereinafter as "QEV"). The preferred QEV valve may be constructed in accordance with Global Manufacturing U.S. Pat. No. 6,726,059 issued Apr. 27, 2004, which is hereby incorporated by reference for purposes of disclosure.

With joint reference now directed to FIGS. 4-11, the actuator 30 controls a plunger assembly, designated generally by the reference numeral 50 (i.e., FIG. 4, 5, 8), that is operationally positioned within the tank 21. Actuator 30, mounted on actuator tank end 22, interacts through the plunger assembly 50 with a plunger seat adaptor assembly 70 (FIG. 4) to interiorly block or unblock blast discharge air flow. As appreciated from FIG. 9, for example, in operation the plunger assembly 50 selectively blocks or unblocks air flow through seat adaptor assembly 70, internal seat discharge adaptor pipe 71, and a high pressure outlet pathway 204 (FIG. 9) established by a permanently mounted, aerator output tube 24, external pipe coupling 26, and discharge pipe 28 (FIG. 1). Output tube 24 is permanently welded during fabrication into the tank's tapered discharge end 23. When unblocked, high pressure air rushes out through the air outlet pathway 204 through the external aerator discharge pipe 28 into the intended application. The tank interior 203 is periodically charged with HP air provided by a normal industrial HP air interconnection coupled to trigger valve 85 exteriorly of the tank via inlet port 101 (FIG. 9). Air flow and aerator pressurization charging are discussed below.

In assembly, the generally tubular plunger seat adaptor assembly 70 is coaxially connected to output tube 24 with seat adaptor pipe 71. The ID 93 of the output tube 24 is machined to tolerance to communicate with the seat adaptor pipe 71 whose machined end has an O-ring groove 76 to seat an O-ring 78 (FIG. 9). Seat 77 (FIGS. 6, 9-12) is engaged by the plunger assembly plunger element 52 (FIG. 9, 12, 13) for air control.

Figure 11:
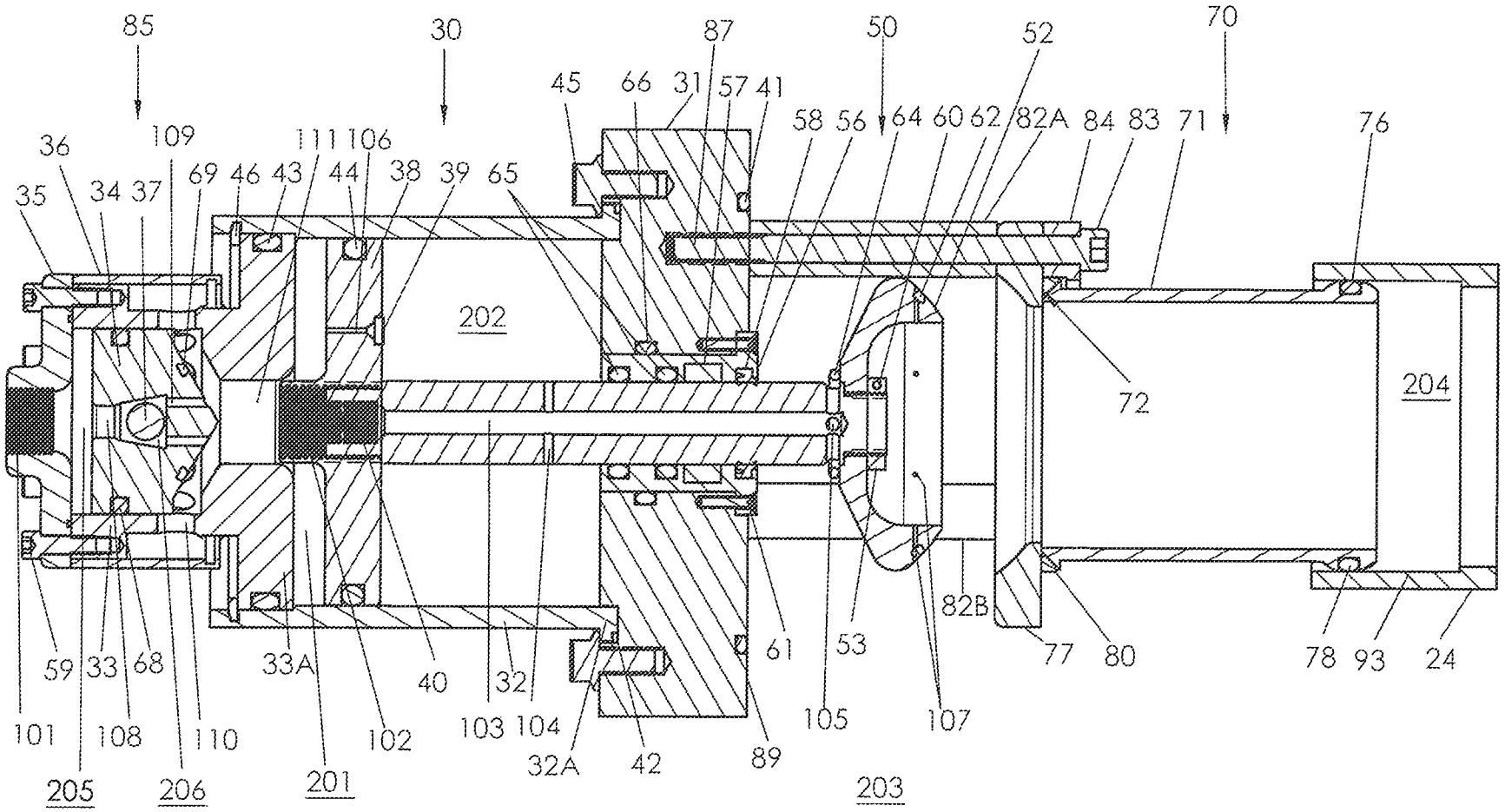
Figure 12:
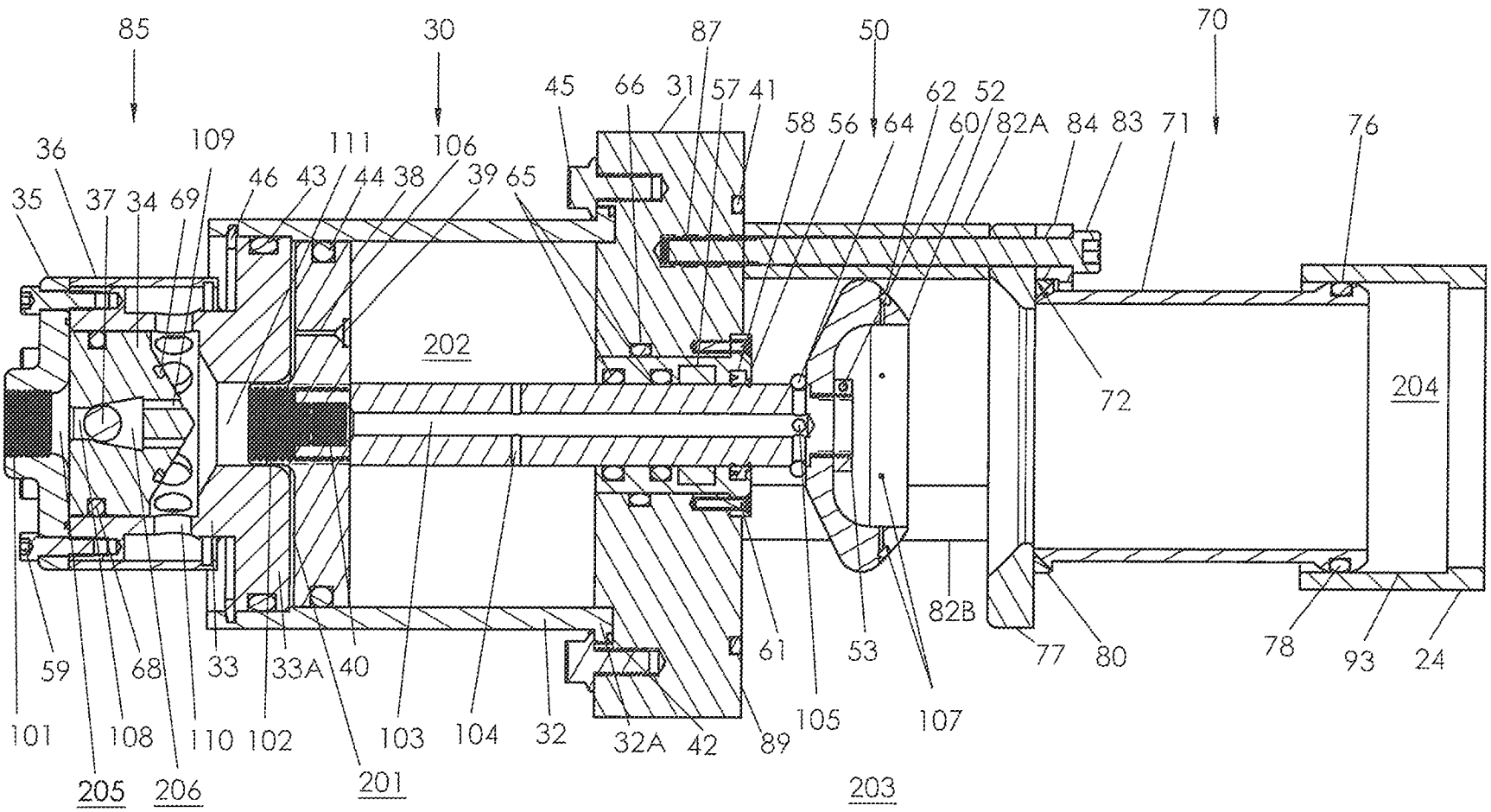
Figure 16:
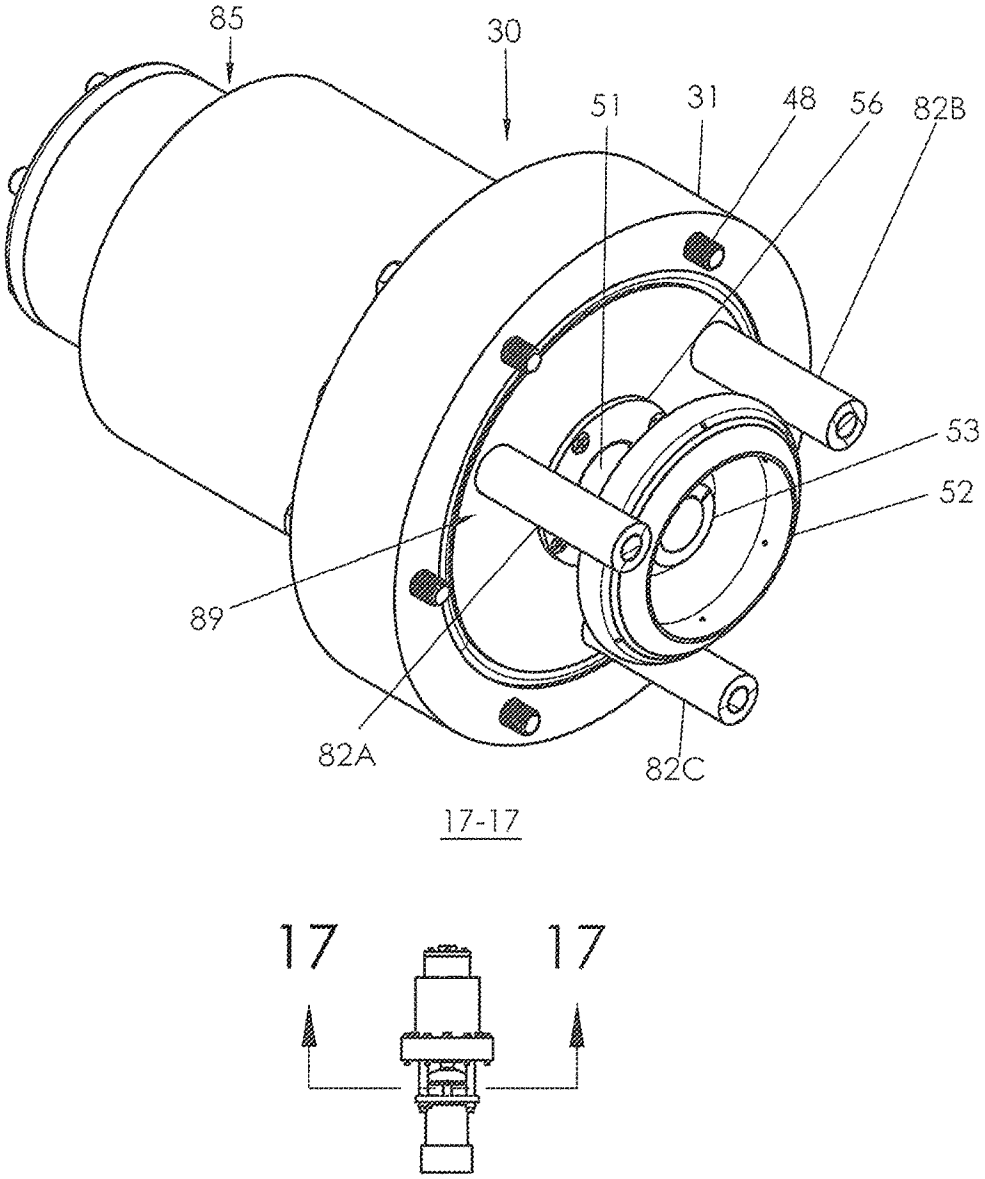
FIG. 16 is an enlarged isometric view of the aerator control module, the plunger element and its cage.
Figure 17:
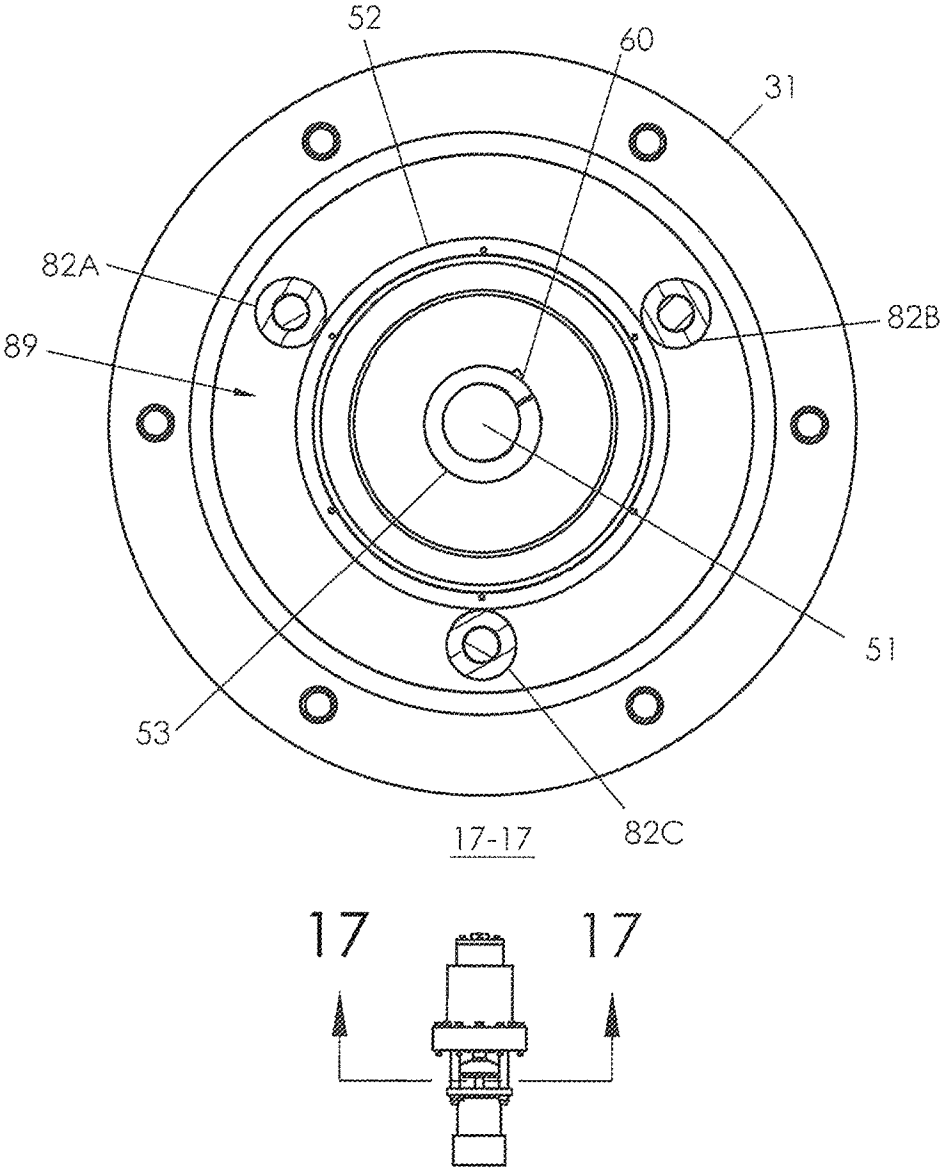
FIG. 17 is an end elevational view taken from a position generally to the right of FIG. 16 looking in the direction indicated by the arrows along line 17-17.
Figure 18:
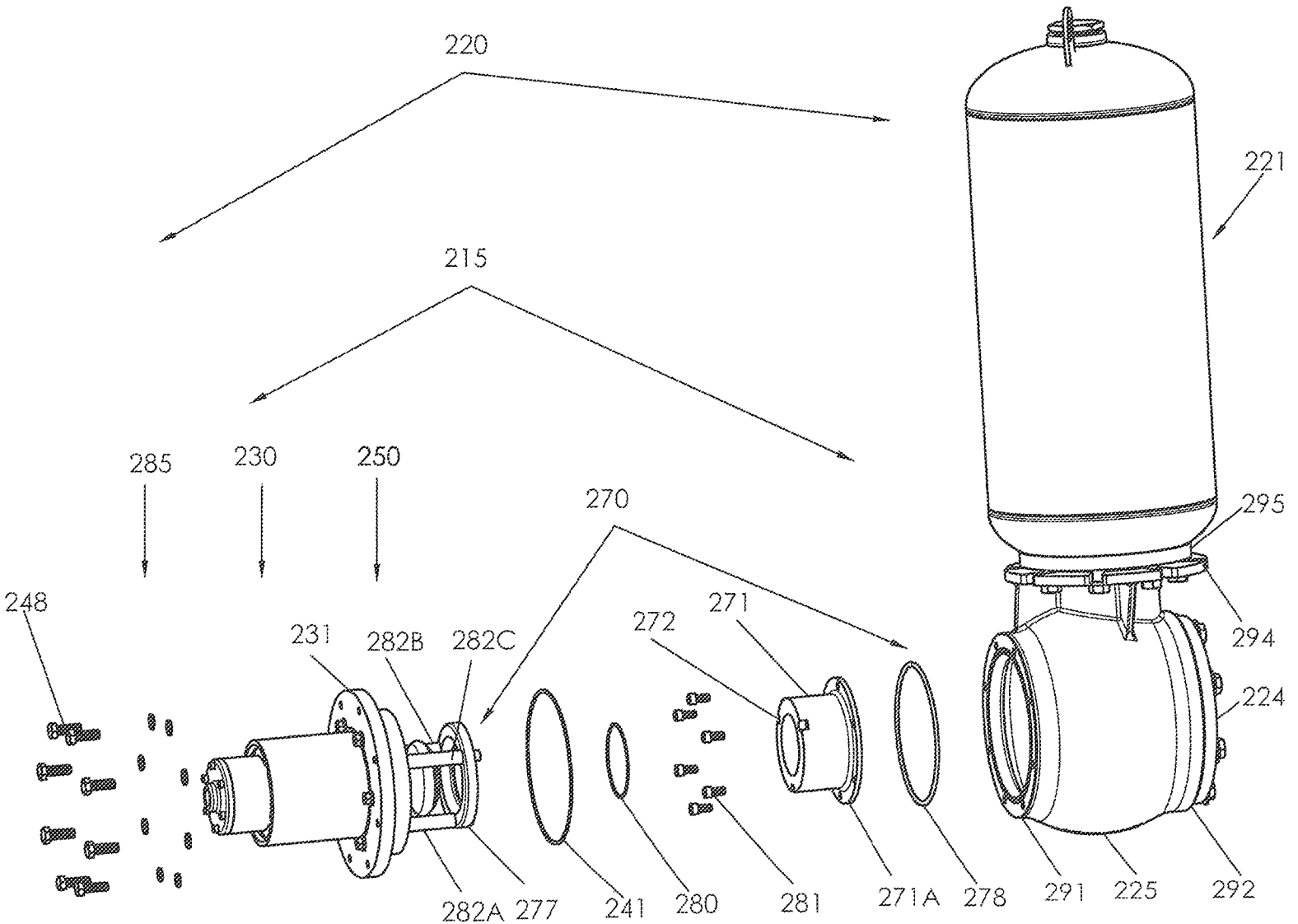
FIG. 18 is an exploded isometric assembly view showing an alternative mounting arrangement and application; and, FIG. 19 is a sectional view showing of the alternative mounting arrangement and application of FIG. 18.

Referring primarily to FIG. 12, the adaptor assembly 70 comprises a plunger adaptor pipe 71 that coaxially engages output tube 24 on its machined end 93. The rigid, tubular seat end of the seat adaptor pipe 71 is coaxially fitted within the machined end 93 of the preexisting output tube 24. The opposite end 72 (FIG. 11, 12) of the seat discharge adaptor pipe 71 coaxially abuts the annular plunger seat 77, that is positioned and held in alignment by a rigid, elongated cage 73 that surrounds the plunger element 52. The cage 73 comprises a plurality of radially spaced apart guide rods, preferably in the form of elongated guide sleeves 82A (FIG. 11), 82B and 82C (FIGS. 16, 18). These sleeves preferably have a tubular construction with a circular cross section (i.e., FIGS. 16 and 17), although sleeves characterized by other cross sections can be used. Rigid fasteners 83, one for each plunger guide sleeve 82A, 82B and 82C, coaxially penetrate the plunger seat adaptor pipe retainers 84, the peripherally located, aligned orifices on the annular plunger seat 77, and these sleeves anchoring within threaded orifices 87 (FIG. 12) defined in the internally facing surface 89 of the actuator mount flange 31. These plunger guide sleeves 82A, 82B, and 82C define the cage 73 to insure that the seat 77 is coaxially disposed and properly aligned and distanced to be correctly engaged by plunger element 52, so that a proper seal can be made against seat 77. The plunger seat adaptor pipe retainers 84 secure the seat adaptor pipe 71. Thus the cage 73 consisting of the retainers 84, the plunger guide sleeves 82A, 82B, and 82C, and the rigid fasteners 83 secure both the plunger seat 77 and the seat adaptor pipe 71 so that when the aerator control module 15 is removed from the tank, the plunger seat 77 and the entire seat adaptor assembly 70 are removed simultaneously.

Figure 4:
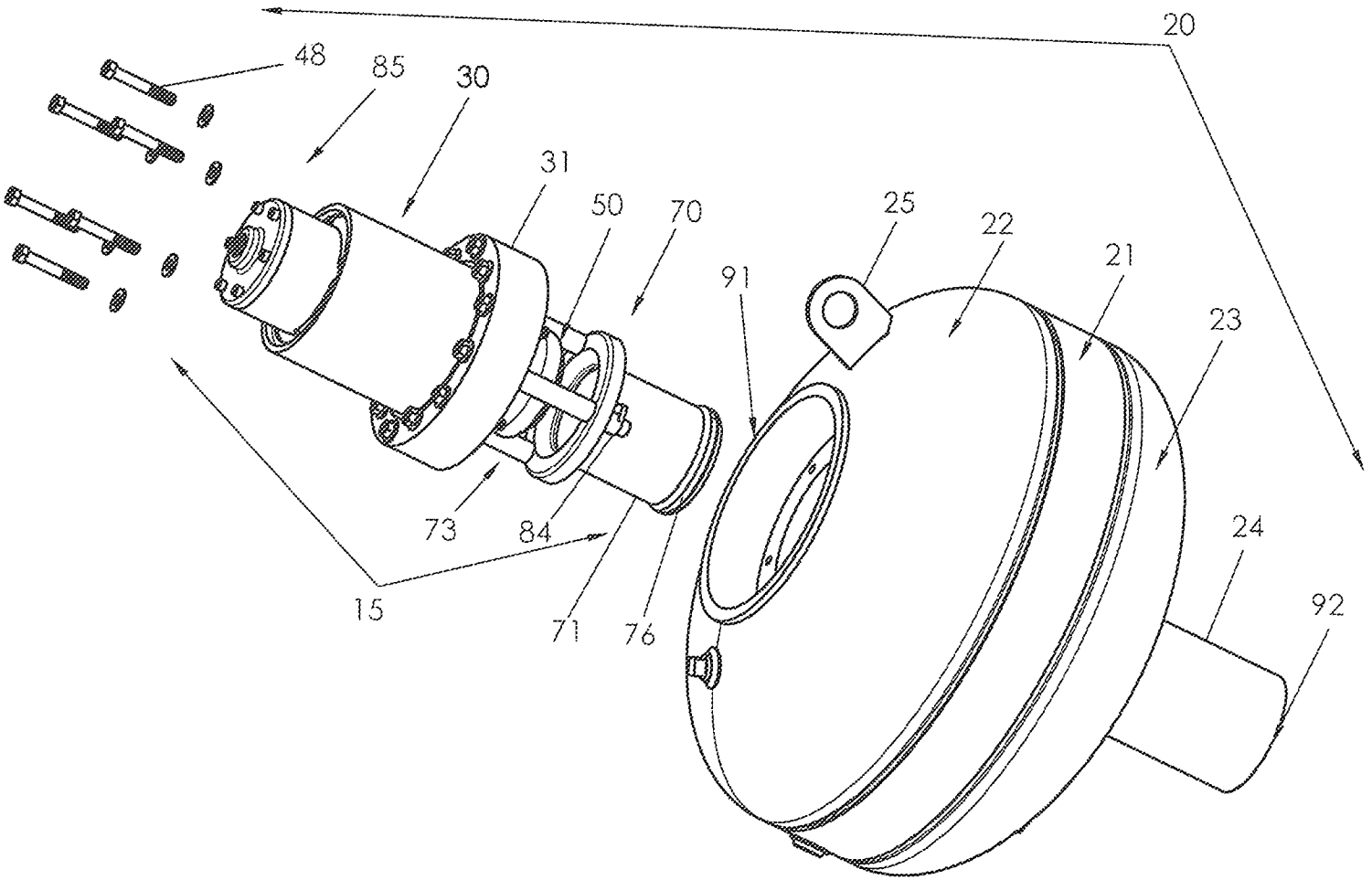
FIG. 4 is a fragmentary, partially exploded, isometric assembly view thereof.
Figure 5:
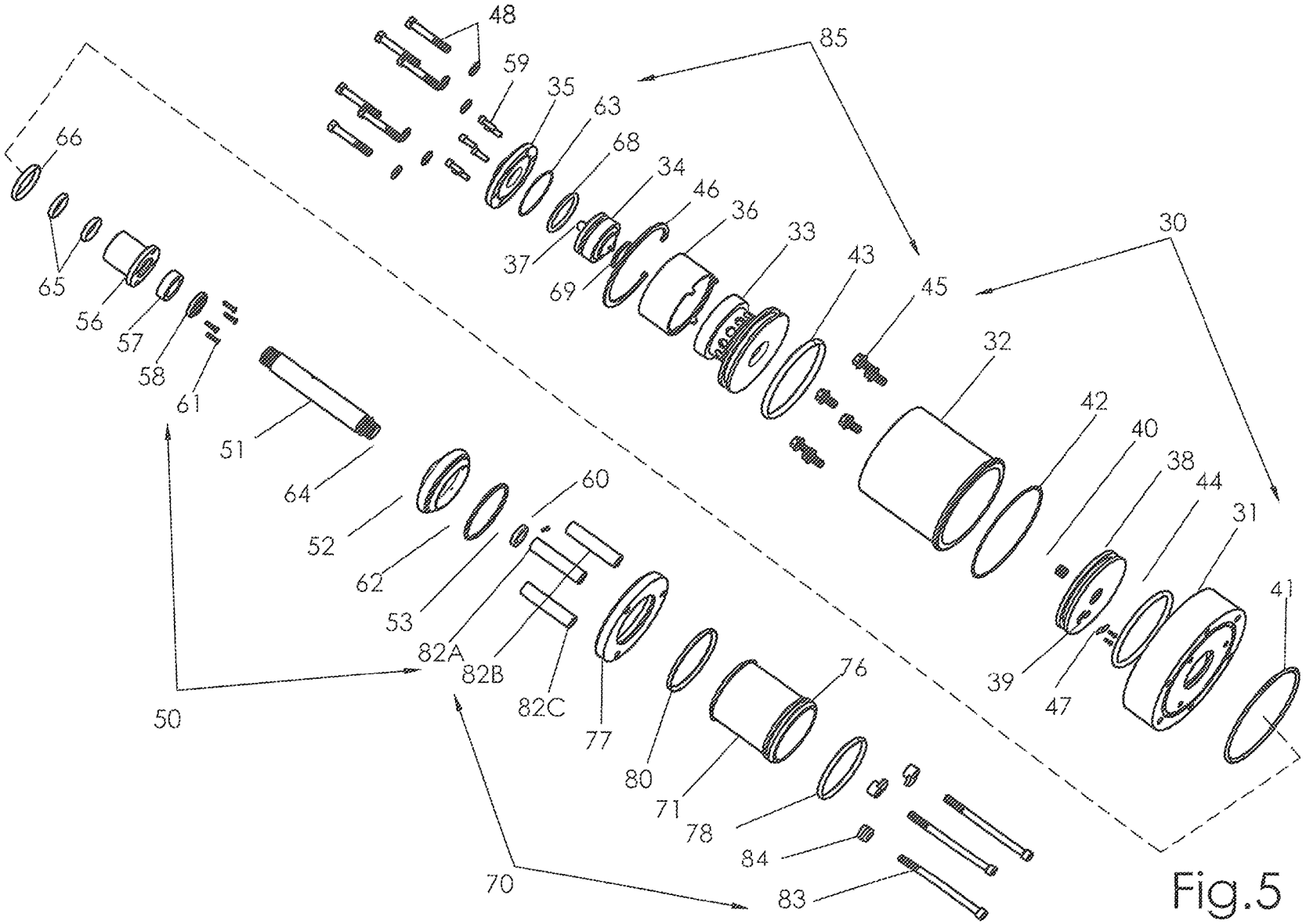
FIG. 5 is an exploded isometric assembly view.
Figure 6:
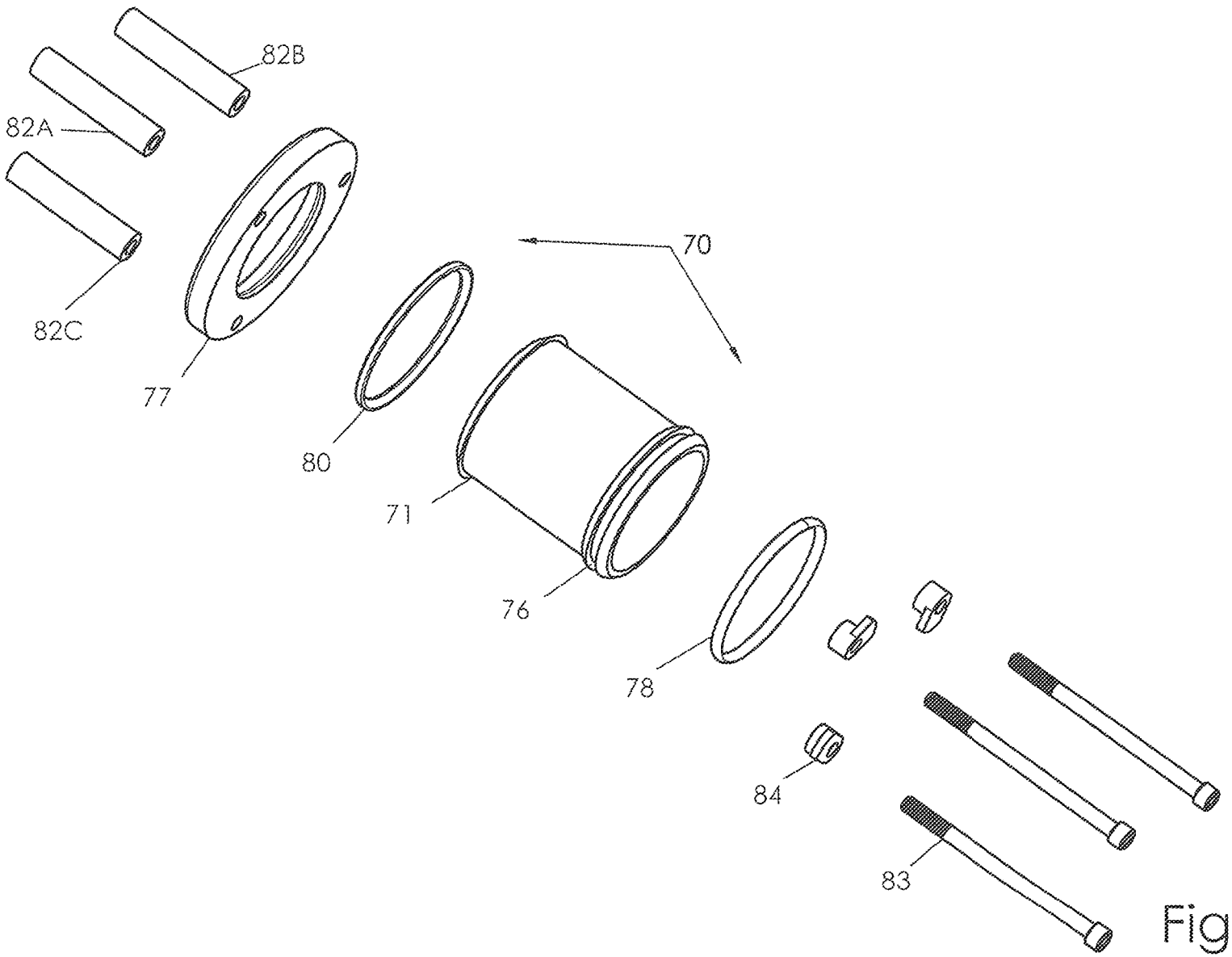
FIG. 6 is an enlarged, exploded isometric view of the preferred seal adaptor, cage, and related hardware.
Figure 10:
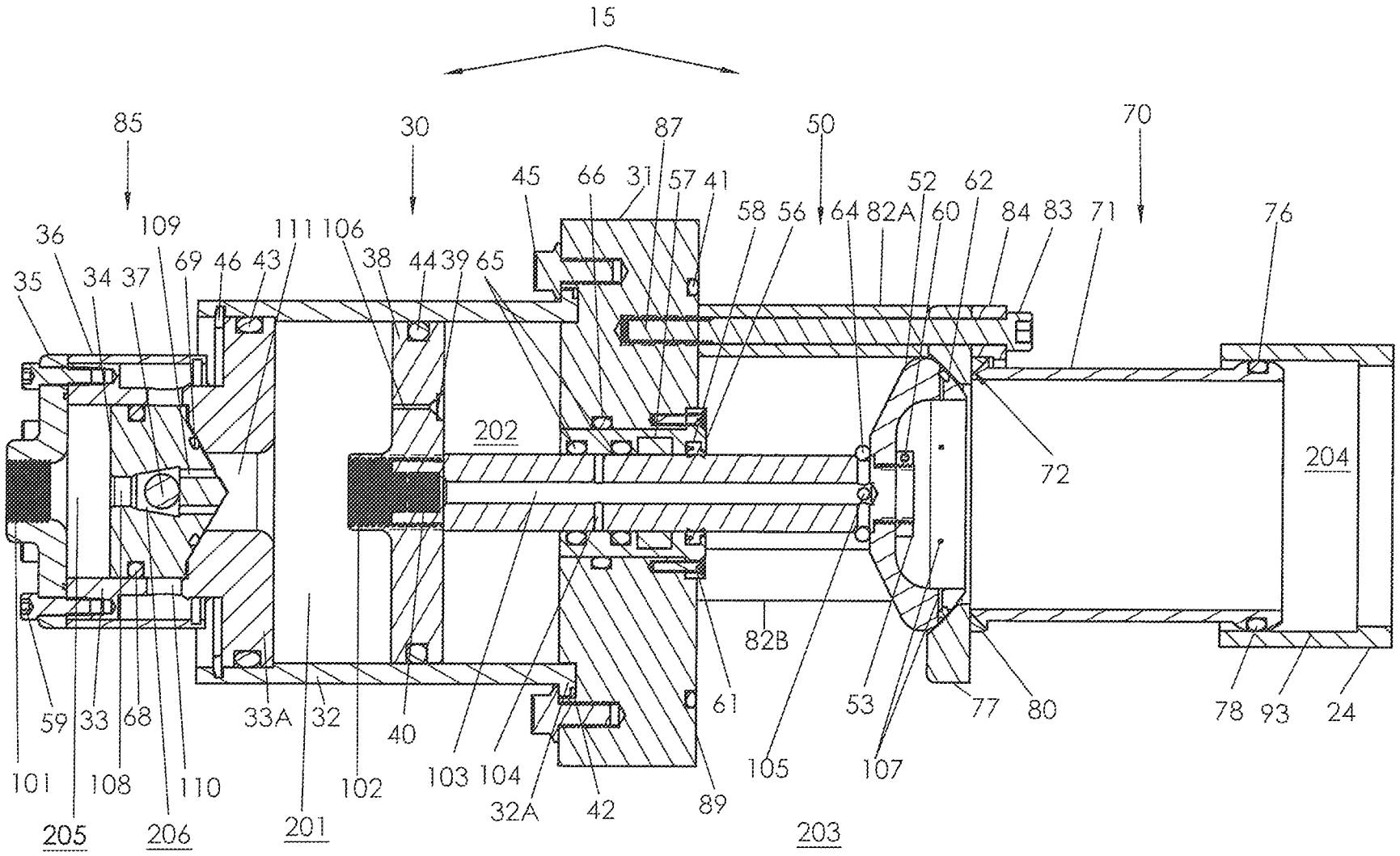
FIGS. 10, 11, and 12 are enlarged, fragmentary, longitudinal sectional views showing actuator components in various stages of operation.

The actuator 30 is part of the control module 15, and it interacts with the plunger assembly 50 for aerator operation, as suggested, for example, by FIGS. 10, 11 and 12. Actuator 30 is externally and coaxially secured to the actuator end 22 of the tank 21 by a rigid, circular mounting flange 31 (i.e., FIGS. 4, 5, 9, 10) that is coaxially secured to the tank inlet flange 91 by suitable fasteners 48 (FIG. 4, 5, 9). A rigid, tubular actuator housing 32 (i.e., FIGS. 5, 10, 14) is coaxially retained upon the mounting flange 31 by flanged bolts 45 that abut against actuator housing rim 32A (FIG. 12), which is coaxially seated within an annular ring groove defined within mounting flange 31 (FIG. 10). A conventional O-ring seals rim 32A of tubular actuator housing 32.

Figure 7:
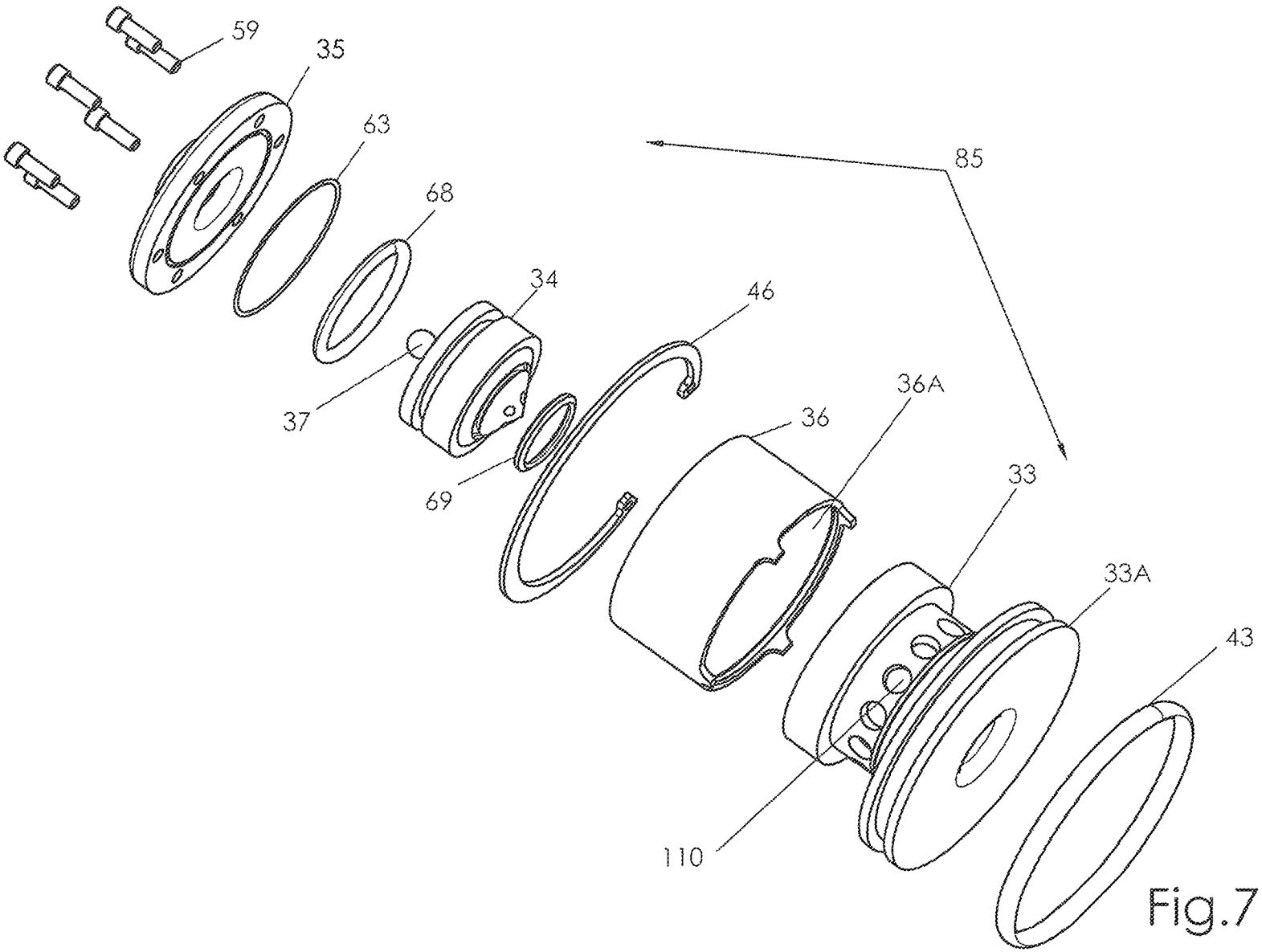
FIG. 7 is an enlarged, exploded isometric view of the preferred quick exhaust valve within the aerator control module.
Figure 8:
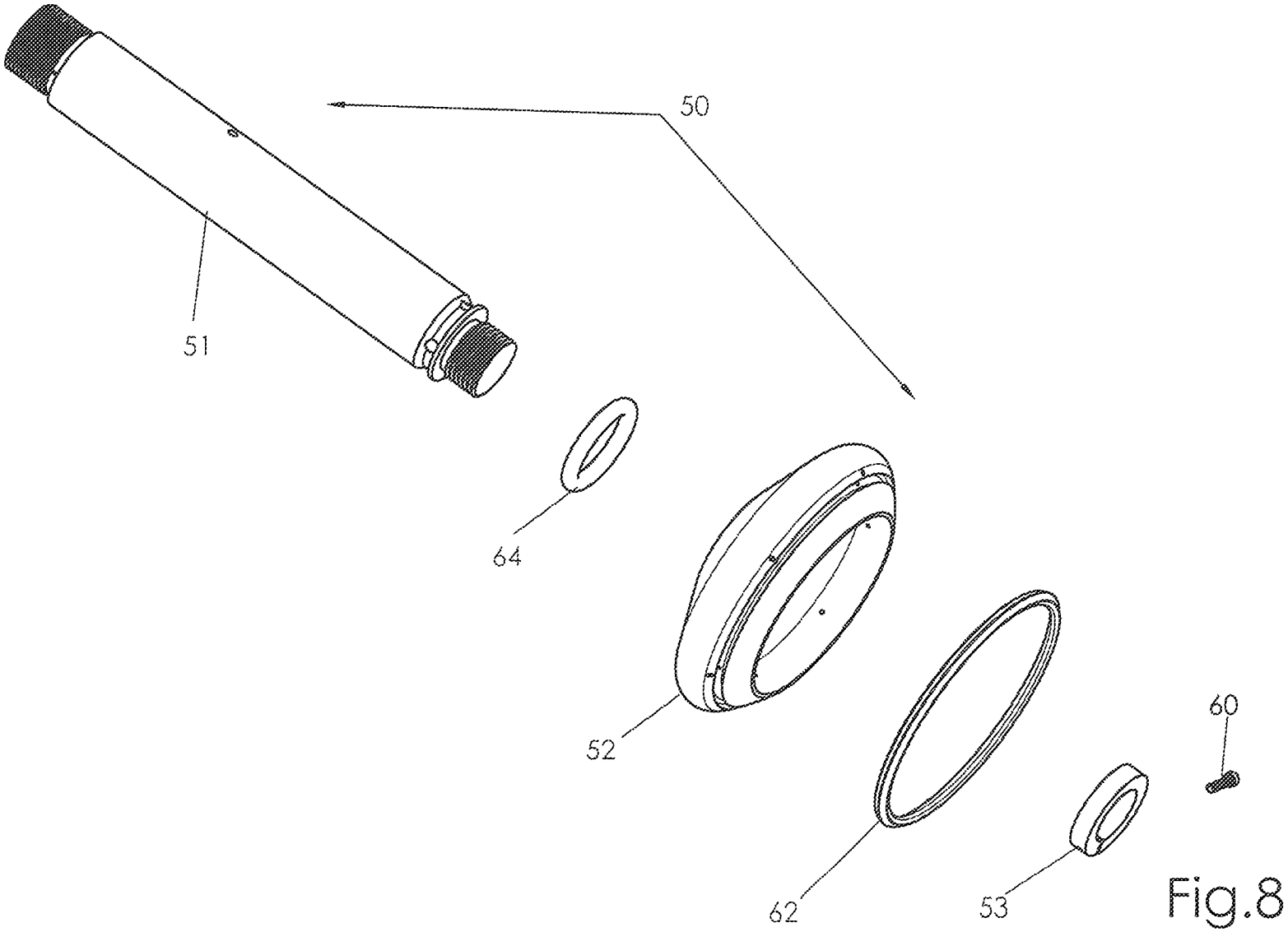
FIG. 8 is an enlarged, exploded isometric view of the plunger assembly, with portions thereof omitted for brevity or clarity.
Figure 14:
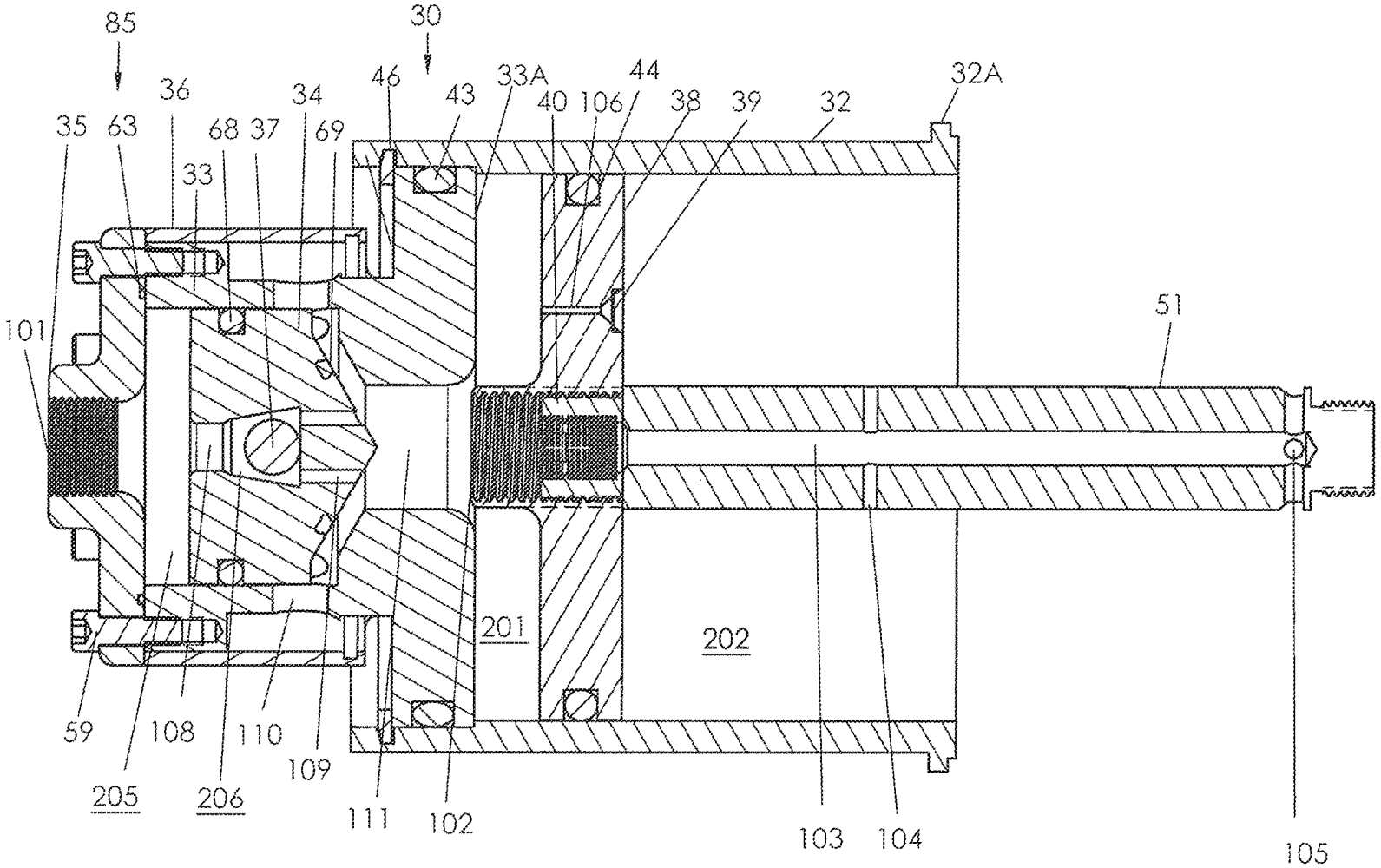
FIG. 14 is an enlarged, fragmentary, longitudinal sectional view illustrating portions of the externally mounted aerator control module and plunger controller.

The aerator control module 15 comprises an external trigger valve 85 (preferably a QEV) mounted upon the tubular actuator housing 32 (FIG. 11). A generally cylindrical and tapered QEV piston 34 is slidably disposed within QEV housing 33 which has an integral, spaced-apart generally coaxial base 33A (FIG. 14) that is sealed within actuator housing 32 by a suitable O-ring 43, being secured by a retaining ring 46 (i.e., FIG. 7). QEV piston 34 borders a plurality of radially spaced-apart exhaust ports 110 (FIGS. 7, 10) located in the cylindrical wall of the QEV housing 33 (FIGS. 7, 14). There is an elongated passageway 111 coaxially penetrating the QEV housing base 33A that provides a pathway for factory HP air from inlet 101. Passageway 111 leads to an interior cavity 201 (FIG. 10, 14) defined between a slidable actuator piston 38 and the trigger valve (i.e., preferably QEV) housing base 33A. The trigger valve 85 supplies quick depressurization of space 201 that is necessary to achieve a maximum force discharge blast.

The passageway 111 communicates with the twelve radially oriented exhaust ports 110 (FIG. 7) whenever the QEV piston 34 is in the "open" position fully positioned against the QEV cap 35. The spring-less piston 38 deflects and controls a plunger assembly 50 (i.e., FIG. 11) to block (i.e., FIGS. 10, 11, 12) and unblock passageway 204 (i.e., FIGS. 9, 10, 11, 12) discussed above.

The QEV piston 34 is generally cylindrical with a cone shaped end facing the QEV housing base 33A and passageway 111. The QEV piston 34 has an internal cavity 206 that communicates with the conical end of the piston by four cylindrical exit ports 109. The internal cavity 206 communicates with the flat end of the piston 34 by a single cylindrical piston inlet port 108. The QEV piston 34 has an O-ring groove around its OD surface for an O-ring 68 that provides a seal between the QEV piston 34 and the QEV housing 33. A second O-ring groove located on the conical nose of QEV piston 34 seats an O-ring 69 (FIG. 14) and periodically provides a seal between the conical nose of the QEV piston 34 and the QEV housing base 33A. A small, spherical check valve 37 pressed into the QEV piston internal cavity 206 allows air to pass through the QEV piston 34 in only one direction from the inlet port 101, space 205, piston inlet port 108, QEV cavity 206 (FIG. 14) and out the four cylindrical exit ports 109 on the conical nose of the piston that can conduct air to base passageway 111 (FIG. 14).

The tubular QEV exhaust port protector 36 (FIGS. 7, 10) slidably, coaxially confines QEV housing 33 and protects the QEV exhaust ports 110 from outside contamination. Cutouts 36A on the end near the QEV housing base 33A allow the passage of air from the QEV exhaust ports 110 to the surrounding atmosphere. A flat circular cap 35 comprising centrally located threaded inlet port 101 mounts to the top surface of the QEV housing 33, trapping the slidable QEV piston 34 and the QEV exhaust port protector 36. The inlet port 101 provides a pathway for factory HP air to reach the QEV piston inlet port 108 and the QEV piston internal cavity 206.

Referencing FIGS. 5-14, the plunger assembly 50 periodically blocks the air outlet pathway 204 previously discussed. Plunger assembly 50 comprises an elongated, rigid plunger rod 51 (FIGS. 8, 13, 14) that interiorly, coaxially penetrates actuator 30 and mechanically anchors to the slidable actuator piston 38 (i.e., FIGS. 10, 14). The actuator piston 38 is prevented from loosening from the plunger rod 51 by a NPT expansion fitting 40 which screws into the split, internally threaded end of the plunger rod 51. As the NPT expansion fitting 40 is tightened the OD of the plunger rod is pushed outward preventing the actuator piston 38 from coming loose from the plunger rod 51. The NPT expansion fitting 40 has a coaxial hole through the center serving as the plunger rod entry port 102 allowing air in space 201 to pass through the NPT expansion fitting 40 to plunger rod airway 103. The actuator piston 38 controls plunger rod movement to block and unblock the seat 77 (i.e., FIG. 9).

Figure 13:
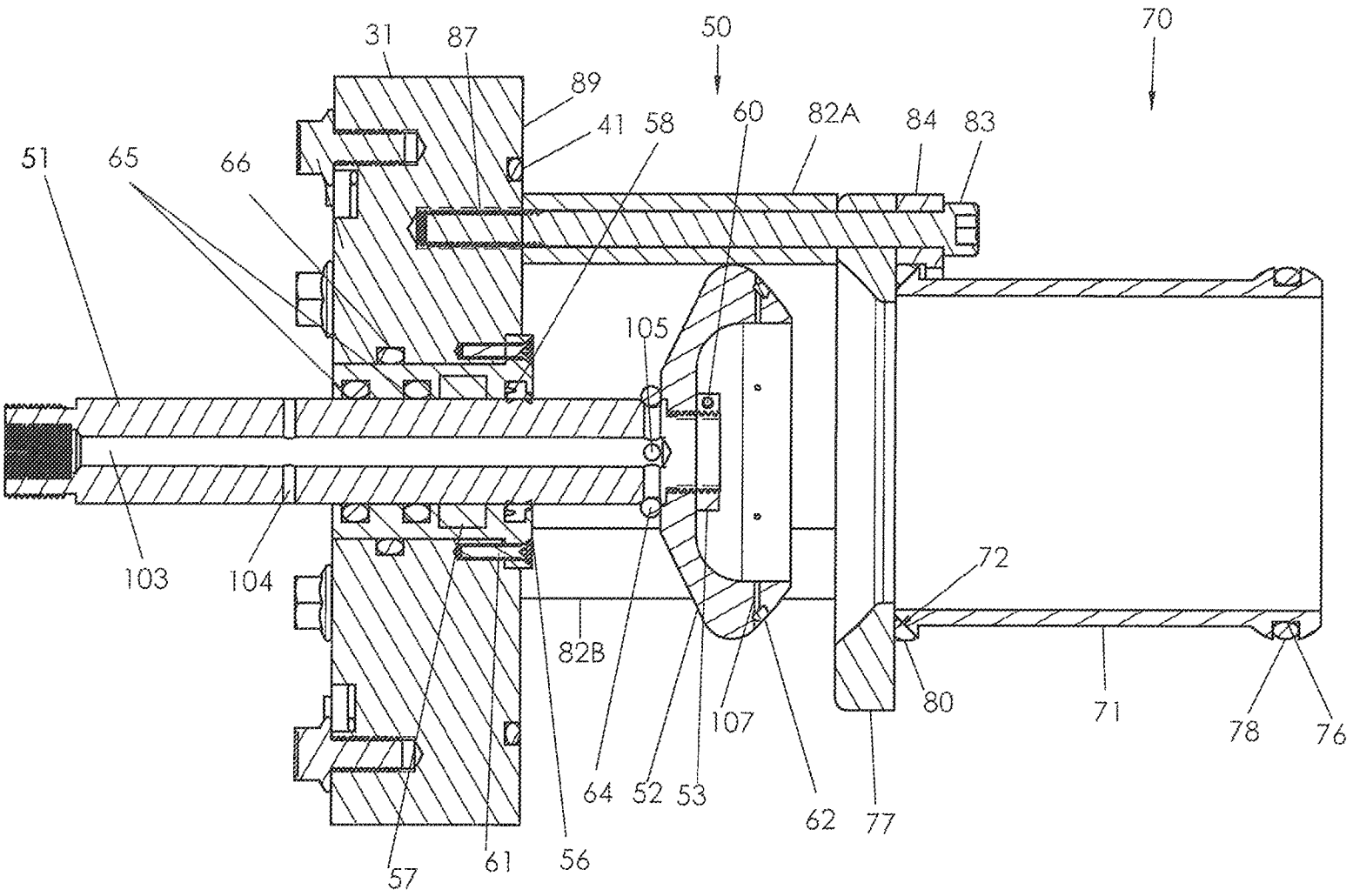
FIG. 13 is an enlarged, fragmentary, longitudinal sectional view of the plunger and the plunger seat adaptor assembly.

The hollow piston rod 51 coaxially passes through a resilient wear insert 56 (FIG. 11) mounted in the flange 31 which is secured by mounting screws 61 (FIG. 13). The wear insert 56 is sealed by a concentric O-ring 66 seated with a ring groove within mounting flange 31. The rod 51 passes through the wear insert 56 and is sealed by concentric O-rings 65 (FIG. 11) and a concentric seal/wiper 58, which prevents contaminants from reaching the actuator. Between the O-rings and seal/wiper is a wick lubricator 57, which lubricates the plunger rod where it passes through the seals, minimizing wear and heat build-up that can occur from the extremely rapid movement of the plunger rod during blast aerator use. The concentric seal/wiper 58 also helps to keep the lubrication provided by the wick lubricator 57 confined to the section of the plunger rod that moves within the wear insert 56.

Figure 15:
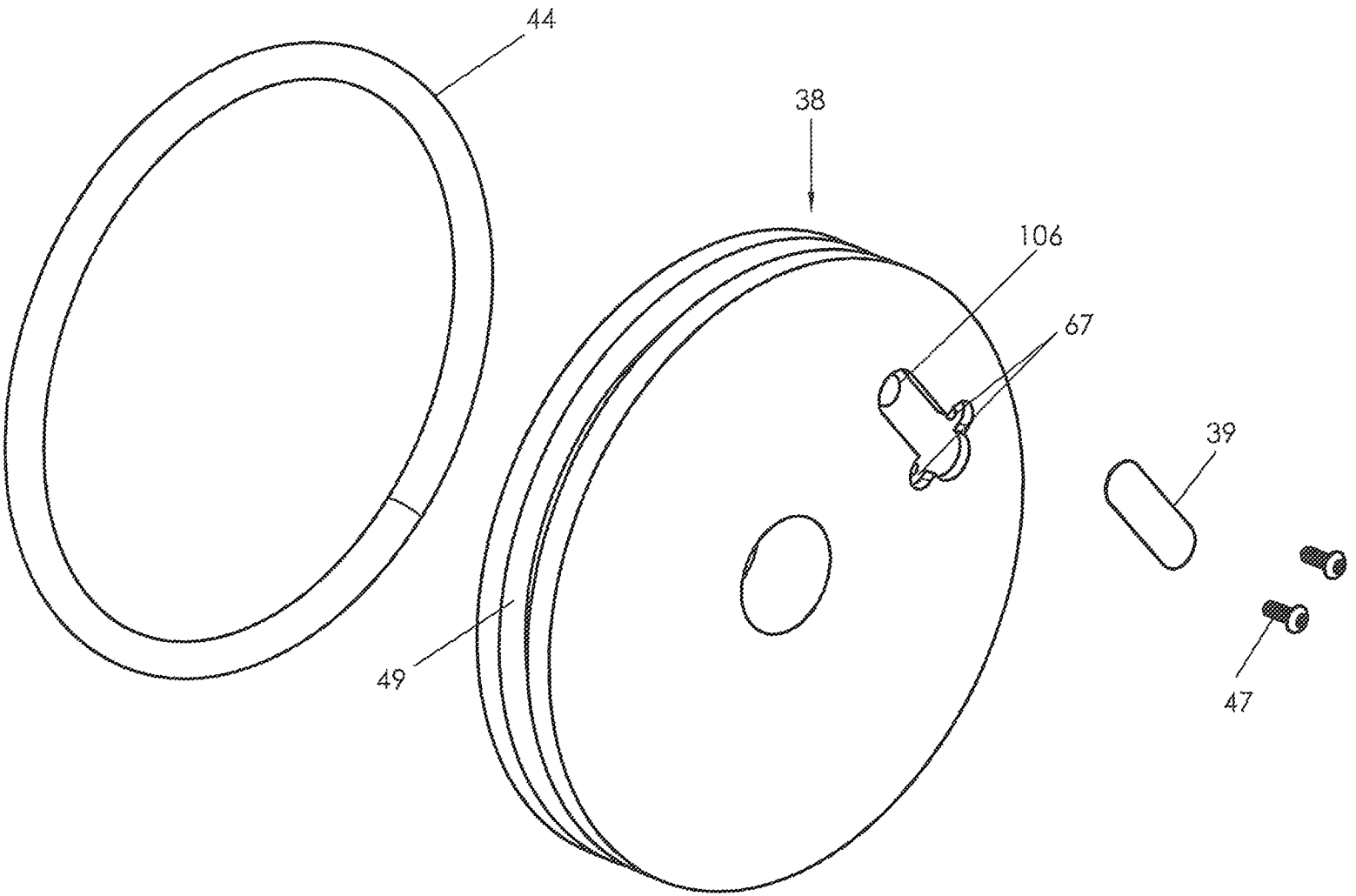
FIG. 15 is enlarged, exploded, isometric view, with portions omitted for brevity, showing the one-way reed valve.

Actuator piston 38 is displaceable coaxially within actuator housing 32, being sealed by an appropriate O-ring 44 (FIG. 11) seated within peripheral ring groove 49 (FIG. 15). A small vent 106 (i.e., FIGS. 14, 15) passes through the thickness of the actuator piston 38 connecting a first cavity 201 with second cavity 202 (FIG. 14), the space between the actuator piston 38 and the actuator mount flange 31. This vent 106 is controlled by a one-way reed valve 39 (FIG. 14, 15) held by fasteners 47 (FIG. 15) seated within partial orifices 67. When air pressure is applied through passageway 106 it pushes the reed valve back to let air flow into space 202. When air pressure drops in 106 the reed cannot bend the other way because it fits snugly against the piston, thus air cannot flow back from space 202 into 106. An elongated plunger rod airway 103 extends interiorly through plunger rod 51, communicating with plunger rod entry port 102 (FIG. 14), four radially spaced-apart plunger rod exit ports 105 (FIGS. 11, 14), and travel control ports 104 (FIG. 14). A concentric O-ring 64 (FIG. 11) fits into a concentric groove in the plunger rod 51 adjacent exit ports 105 to form a check valve, which controls the flow of air through the plunger rod exit ports 105. The O-ring 64 can be resiliently deflected away from the encircled ports 105 to open them by internal pressure, but it closes ports 105 in response to external pressure.

The plunger sealing element 52 (i.e., FIGS. 8 and 13) is periodically forced against or withdrawn from the previously described seat 77 (i.e., FIG. 10, 11, 12) during aerator operation. The reciprocating plunger element 52, displaceable within cage 73, has an axial threaded hole that allows it to be mounted on the threaded end of the plunger rod 51 distally to the plunger rod exit ports 105. The plunger element 52 is secured to the plunger rod 51 with a threaded plunger lock collar 53 (FIG. 11) which is threaded onto the plunger rod 51 distally to the plunger element 52. The plunger lock collar 53 is secured from loosening by a clamp screw 60. An O-ring 62 seated in a vented dovetail groove 86 cut into the nose of the plunger sealing element 52 provides a seal when aligned with the plunger seat 77 to prevent air leakage from the internal tank space 203 into the air outlet pathway 204 when the blast aerator is fully charged and waiting to be fired (FIG. 10). The dove tail groove 86 with six vent airways 107 are used to prevent the O-ring 62 from becoming displaced from the face of the plunger nose when the plunger is abruptly pulled back and away from the plunger seat 77 during firing of the air cannon.

Alignment of the plunger sealing element 52 with the seat 77 is critical. Normally the discharge tube 24 in older blast aerators being repaired by the retro-fittable aerator control module described in U.S. Utility patent application Ser. No. 16/380,322 is traditionally schedule 40 pipe that is welded in place. The end of that tube, and thus the seat, most likely will not be in proper axial alignment with the plunger. That design had many physical adaptations that allowed the plunger to rock slightly in all directions while maintaining basic alignment at all times, to make sure the plunger element 52 would align and properly seal against the plunger seat 77. The present design is much simplified because this aerator control module 15 is not for use in retrofitting existing blast aerators but is for new blast aerator fabrication where the tank construction is specially designed to minimize the misalignment of the discharge tube 24. This is accomplished by using thicker schedule 80 pipe instead of schedule 40 pipe for the discharge tube 24. Because of the added thickness the end of the discharge tube 24 can be machined on the ID at one end 93 to close tolerances allowing the seat adaptor pipe 71 when inserted into the machined end 93 of the discharge tube 24 to effectively seal with a simple o-ring seal 78. Also, the tank profile is shortened so that the length of the discharge tube 24 is minimized further reducing alignment problems. The plunger assembly 50 comprises a plunger element 52 which mates with and seats within a plunger seat 77, which is part of the plunger seat adaptor assembly 70 previously described. The plunger assembly construction no longer needs to compensate for misalignment of the output tube 24 because of improvements in tank design.

The cage 73, comprising the three plunger guide sleeves 82A, 82B and 82C along with the accompanying retainers 84 and fasteners 83, secures the plunger seat 77 in proper position and axial alignment for the plunger element 52 to properly seal against the plunger seat 77. The retainers 84 are used to secure the plunger seat 77 against the seat adaptor pipe 71 seat mount surface 72 with a seal between the two provided by the plunger seat o-ring 80. Once the three sleeve fasteners 83 are secured in the threaded holes 87 in the actuator mount flange 31, all of the aerator control module components (the actuator assembly 30, plunger assembly 50, and seat adaptor assembly 70 are secured together as one component 15. The aerator control module 15 can now be inserted, seat adaptor 70 end first, into the tank inlet flange 91. The end of the seat adaptor pipe 71 will slide into the machined end 93 of the discharge tube 24. O-ring 78 will seal the juncture of the seat adaptor pipe 71 and discharge tube 24. The actuator mount flanged 31 is secured to the tank inlet flange 91 with the six fasteners with washers 48. This completes the installation of the aerator control module 15 in to the blast aerator tank 21.

Figure 19:
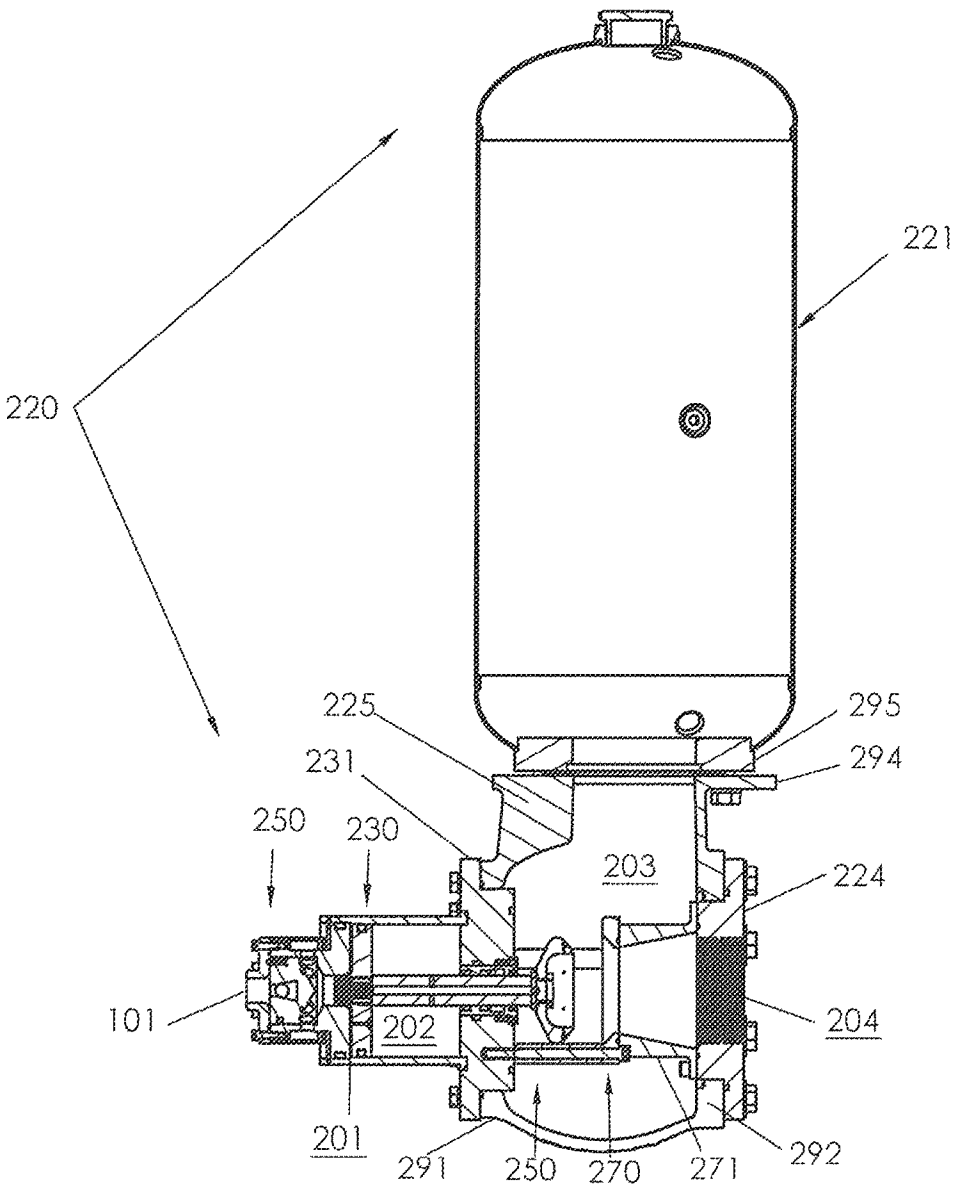

FIGS. 18 and 19 illustrate how the aerator control module can also be used in an external valve configured blast aerator. To use the aerator control module 215 in an external valve configuration there must be an external valve housing 225 with an inlet flange 291, an outlet flange 292, and a tank mount flange 294. The tank mount flange 294 is bolted with appropriate fasteners to the mount flange located at one end of an aerator tank 221. Instead of an aerator outlet tube 24 as described previously, an aerator outlet flange 224 is mounted to the external valve outlet flange 292. The aerator outlet flange 224 has a central coaxial four inch hole with standard four inch pipe threads that serves as the airway outlet pathway 204 and provides for attachment to any four inch discharge pipe. The aerator control module 215 has identical components to the aerator control module 15 described previously with respect to a QEV trigger valve 285, the actuator assembly 230, and the plunger assembly 250. Seat adaptor assembly 270 functions like described previously for seat adaptor 70 but the seat adaptor pipe 71 is changed out for the seat adapter pipe 271. Unlike seat adapter pipe 71, seat adapter pipe 271 has a flanged end 271A that bolts with appropriate fasteners 281 to the inside of the aerator outlet flange 224. An o-ring 278 provides a seal between the seat adaptor pipe 271 and the aerator outlet flange 224. The plunger guide sleeves 282 (A,B,C) hold the plunger seat in place but do not secure the seat adapter pipe 271 as described in the previous configuration. Once the plunger seat adaptor pipe 271 is mounted inside the external valve housing 225 to the aerator outlet flange 224, and an o-ring 280 is appropriately seated in the o-ring groove located on the seat mount surface 272, the aerator control module 215 is inserted into the inlet flange 291. The plunger seat 277 will seal against the seat mount surface 272 as the actuator mount flange is secured to the inlet flange 291 with the appropriate fasteners 248. The space 203 in the external valve housing 225 is contiguous with the air stored in the interior of the aerator tank 221. Therefore the aerator control module 215 installed in the external valve configuration will function identically to what has been previously described.

Operation:

A.) Compressed air enters the top of the trigger valve 85 through the air inlet port 101 (FIG. 14) located in the top of QEV cap 35 and passes into the QEV cylindrical interior (i.e., cavity 205 between the QEV piston 34 and the QEV cap 35).

B.) Increased pressure on the back of the QEV piston 34 pushes it towards the QEV exit port 111. The cavity 205 enlarges and the O-ring 69 on the nose of the QEV piston 34 seals against the QEV housing base 33A around the QEV exit port 111. This prevents air flow from port 111 to the 12 QEV exits ports 110.

C.) Increased pressure at the back of the QEV piston 34 allows air flow into the QEV piston inlet port 108 and into the QEV piston internal cavity 206. This increased pressure pushes the QEV piston ball valve into the "open" position allowing the air to flow from the QEV piston internal cavity 206 through the four QEV piston exit ports 109 into the QEV exit port 111 and into cavity 201 the space between the actuator piston 38 and the QEV housing base 33A.

D.) From cavity 201 compressed air passes through the piston 38 and into the plunger rod, entering through entry port 102 and passing through plunger rod airway 103, and opening the check valve provided by O-ring 64 that can be deflected away from the encircled ports 105. Air escaping ports 105 reaches the internal tank space 203 (FIG. 9) to charge the aerator 20. The one-way check valve O-ring 64 prevents air in the internal tank space 203 from ever moving back into the plunger rod airway ports 105. Thus a first operational air pathway, to fill the aerator tank and charge it for a subsequent output blast, is established by inlet port 101, QEV piston inlet port 108, QEV piston exit ports 109, QEV exit port 111, rod entry port 102, plunger rod airway 103, and ports 105.

E.) A second operational air pathway delivers compressed air through cavity 201 to slowly pressurize cavity 202 to a pressure less than the pressure in cavity 201. Pressured air reaching cavity 201 (FIG. 14) passes through the balance vent 106 in the actuator piston 38 and through a one-way actuator reed valve 39 to pressurize cavity 202 between the actuator piston 38 and the actuator mount flange 31. The reed valve 39 prevents air in cavity 202 from ever moving back into the actuator piston vent 106.

F.) Since the pressure in cavity 202 is slightly less than the pressure in cavity 201, the actuator piston 38 is pushed towards the actuator mount flange 31 causing the plunger rod 51 to seat the plunger sealing element 52 in the plunger seat 77 as in FIG. 10, preventing air in tank cavity 203 from exiting through the air outlet pathway 204 (i.e., FIGS. 9, 11, 12). The tank fills until the pressure equalizes in cavities 201, 202, and 203. The blast aerator is now ready to fire.

G.) To fire the blast aerator, the air is drawn off the air inlet port 101 and the pressure in cavity 205 drops. Since pressure at the QEV exit port 111 is greater than in cavity 205, the QEV ball valve 37 is pushed into the "closed" position. This blocks all air in the aerators airways from exiting through the air inlet port 101.

H.) Because the pressure at the QEV exit port 111 is greater than in the cavity 205, the QEV piston 34 is rapidly pushed towards the air inlet port 101, closing cavity 205 and opening up a pathway for air to flow from the QEV exit port 111 to the twelve QEV exhaust ports 110.

I.) Because the twelve QEV exhaust ports 110 and the QEV exit port 111 are now open to atmospheric pressure, air is space 201 and the plunger rod airway 103 flows towards and out the QEV exhaust ports 110 through the QEV exit port 111.

J.) Since the air is held in cavity 202 by the one-way reed valve 39 and in the tank space 203 by the one-way O-ring check valve 64 blocking ports 105 and plunger rod airway 103, the pressure difference on the actuator piston 38 pushes the piston towards the QEV housing base 33A (i.e., moving to the left as viewed in FIG. 14). The movement of the actuator piston 38 causes the plunger rod 51 to pull the plunger sealing element 52 away from the plunger seat 77 as viewed in FIGS. 9 and 11. This frees pressurized tank air to escape the pressure vessel space 203 through the output tube 24 and out the air outlet pathway 204 (FIGS. 9 & 11).

As recognized by those skilled in the art, to depressurize the cavity 205, and thus fire the trigger valve 85 to fire the blast aerator, a three-way normally open solenoid valve or a three-way manual pneumatic valve may be used. The valve is normally open to the air cannon to supply air. When the valve is closed to the air supply line, the air in the quick exhaust valve (cavity 205) is connected to an exhaust port on the valve that is at atmospheric pressure allowing air to flow out of cavity 205 back through the inlet port 101 and out the exhaust port of the three-way valve. This is the primary way of dropping the pressure in cavity 205 to initiate the firing sequence.

K.) A third important operational air pathway controls piston retraction, i.e., travel of the actuator piston 38 towards the QEV housing base 33A, and thus buffers the piston. First, as the actuator piston 38 retracts towards the QEV housing base 33A (i.e., FIG. 14) the volume in cavity 202 increases, dropping the pressure in cavity 202. As movement of the actuator piston 38 pulls the plunger rod 51 far enough, the travel control ports 104, which connect with the plunger rod airway 103, are exposed in cavity 202 (FIG. 14). This third operational air pathway allows higher pressure air in cavity 202 to move towards cavity 201 through the travel control ports 104, plunger rod airway 103, and the plunger rod entry port 102. Once the pressure in cavities 201 and 202 equalizes, the force moving the actuator piston 38 towards the QEV housing base 33A ceases. Momentum will continue to move the actuator piston 38 towards the QEV housing base 33A until the raised boss on the actuator piston 38, which contains the plunger rod entry port 102, enters and partially obstructs the QEV exit port 111, reducing the flow of air leaving space 201 through the actuator exit port 111. Since air leaving space 202 through the travel control ports 104, the plunger rod airway 103, the plunger rod entry port 102, and the QEV exit port 111 continues unimpeded while the flow of air from space 201 is reduced by the raised boss on the actuator piston 38 obstructing the flow of air from space 201 through QEV exit port 111, the pressure in space 201 will rise above the pressure in space 202 halting the rearward movement of the actuator piston 38 and the actuator piston 38 will not impact the QEV housing base 33A (FIGS. 9 and 12).

L.) Then the first operational air pathway prepares the aerator for a recharge. When pressure is restored at the air inlet port 101, the pressure will again build in cavity 205 causing QEV ball valve 37 to open, the QEV piston to close towards QEV exit port 111 blocking the QEV exhaust ports 110, allowing air to flow through the QEV piston exit ports 109 and the QEV exit port 111 to allow pressure to build in cavity 201. This will cause the piston to move towards the actuator mount flange 31 causing the plunger rod 51 to close the plunger sealing element 52 against the plunger seat 77 once again (i.e., FIG. 10). The blast aerator 20 will refill through the plunger rod airway 103 and the plunger rod exit ports 105 as before. With the piston disposed as illustrated in FIG. 10, it will be noted that travel control port 104 in the plunger rod 51 is closed within the mounting flange 31.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations.

As many possible embodiments may be made of the invention without departing from the scope thereof, it is to be understood that all matter herein set forth or shown in the accompanying drawings is to be interpreted as illustrative and not in a limiting sense.

What is claimed is:

1. A blast aerator comprising:

a rigid air accumulation tank with an actuator end, an interior, and a spaced-apart discharge end, the discharge end coupled to an external discharge pipe that conducts air blasts to an application;

an aerator control module adapted to be fitted to said tank actuator end, said aerator module comprising:

a trigger valve actuator for initiating air blasts from the blast aerator, the actuator comprising an inlet for connection to an external source of high pressure air:

a plunger seat adaptor assembly comprising a seat adapted to be selectively blocked and unblocked;

a plunger assembly controlled by the trigger valve actuator and adapted to be positioned within the tank, said plunger assembly comprising a plunger element for selectively blocking and unblocking said seat and a plunger rod for actuating said plunger element;

a piston coupled to said plunger rod for activating and withdrawing said plunger element;

a protective cage surrounding said plunger element, the plunger element and said plunger rod slidably and coaxially disposed within said cage;

wherein the cage comprises a plurality of elongated, radially spaced apart guide rods, the rods comprising sleeves penetrated by coaxial fasteners that secure the plunger seat in a preselected, fixed position with said plunger substantially aligned relative to said seat;

the actuator end comprising an air inlet that conducts factory air to the interior of said tank for filling and pressurizing the tank when said plunger element is in contact with said plunger seat; and, wherein said trigger valve displaces said piston to fire said aerator.

2. The blast aerator as defined in claim 1 wherein the plunger seat is coaxially connected to an aerator output tube with a seat discharge adaptor pipe.

3. The blast aerator as defined in claim 2 wherein the trigger valve comprises an internal QEV valve that is provided with air ports for conducting air to charge the blast aerator, and wherein factory air travels through an air passageway inside said plunger rod during charging.

4. An aerator control module adapted to be fitted to a rigid blast aerator tank for forming a blast aerator, the tank comprising an interior, an actuator end and a spaced apart discharge end, said aerator module adapted to be fitted to said tank and comprising:

a trigger valve for initiating air blasts from the tank, the trigger valve comprising an inlet for connection to an external source of high pressure air:

a plunger seat adaptor assembly comprising a seat adapted to be selectively blocked and unblocked;

a plunger assembly controlled by said trigger valve and adapted to be positioned within the tank, said plunger assembly comprising a plunger element for selectively blocking and unblocking said seat and a plunger rod for actuating said plunger element;

a piston coupled to said plunger rod for activating and withdrawing said plunger element;

a protective cage surrounding said plunger element the plunger element and said plunger rod slidably and coaxially disposed within said cage;

wherein the cage comprises a plurality of elongated, radially spaced apart guide rods, the rods comprising sleeves penetrated by coaxial fasteners that secure the plunger seat in a preselected fixed position, with said plunger substantially aligned relative to said seat;

the actuator end comprising an air inlet penetrating that conducts factory air to the interior of said tank for filling and pressurizing the tank when said plunger element is in contact with said plunger seat; and, wherein said trigger valve initiates an air blast.

5. The aerator control module as defined in claim 4 wherein the plunger seat is coaxially connected to an aerator output tube with a seat discharge adaptor pipe, and wherein factory air travels through an air passageway inside said plunger rod during charging.

6. The aerator control module blast aerator as defined in claim 5 wherein said trigger valve comprises an internal QEV valve that is provided with air ports for conducting air to charge the blast aerator.

7. A blast aerator comprising:

a rigid air accumulation tank with an interior, an actuator end, and a spaced-apart discharge end, the discharge end coupled to an external discharge pipe that conducts air blasts to an application;

an aerator control module adapted to be fitted to said tank, said aerator module comprising:

a trigger valve actuator for initiating air blasts from the blast aerator, the actuator comprising an inlet for connection to an external source of high pressure air:

a plunger seat adaptor assembly comprising a seat adapted to be selectively blocked and unblocked;

a plunger assembly controlled by the trigger valve actuator and adapted to be positioned within the tank, said plunger assembly comprising a plunger element for selectively blocking and unblocking said seat and a plunger rod for actuating said plunger element;

a piston coupled to said plunger rod for selectively activating and withdrawing said plunger element, said piston isolated from said tank interior by a cylindrical housing in which it is coaxially and slidably disposed;

said housing secured to a rigid mount flange within said tank, and said plunger rod sealably penetrating said mount flange;

the plunger seat maintained in a preselected fixed position by mechanical interconnection with said mount flange, said plunger element thereby being substantially aligned relative to said seat;

the actuator end comprising an air inlet that admits factory air to the interior of said tank for filling and pressurizing the tank when said plunger element is in contact with said plunger seat, the plunger rod comprising an internal air passageway in fluid flow communication with said inlet for conducting air to said tank interior; and, wherein said trigger valve displaces said piston to fire said aerator.

8. An aerator control module adapted to be fitted to a rigid blast aerator tank for forming a blast aerator, the tank comprising an interior, an actuator end and a spaced apart discharge end, said aerator module adapted to be fitted to said tank and comprising:

a trigger valve actuator for initiating air blasts from the blast aerator, the actuator comprising an inlet for connection to an external source of high pressure air:

a plunger seat adaptor assembly comprising a seat adapted to be selectively blocked and unblocked;

a plunger assembly controlled by the trigger valve actuator and adapted to be positioned within the tank, said plunger assembly comprising a plunger element for selectively blocking and unblocking said seat and a plunger rod for actuating said plunger element;

a piston coupled to said plunger rod for selectively activating and withdrawing said plunger element, said piston isolated from said tank interior by a cylindrical housing in which it is coaxially and slidably disposed;

said housing secured to a rigid mount flange, and said plunger rod sealably penetrating said mount flange;

the plunger seat maintained in a preselected fixed position by mechanical interconnection with said mount flange, said plunger element thereby being substantially aligned relative to said seat;

the actuator end comprising an air inlet that admits factory air to the interior of said tank for filling and pressurizing the tank when said plunger element is in contact with said plunger seat, the plunger rod comprising an internal air passageway in fluid flow communication with said inlet for conducting air to said tank interior; and, wherein said trigger valve displaces said piston to fire said aerator.

* * * * *